US009199490B2

(12) United States Patent
Yamada et al.

(10) Patent No.: US 9,199,490 B2
(45) Date of Patent: Dec. 1, 2015

(54) RECORDING DEVICE

(71) Applicant: SEIKO EPSON CORPORATION, Tokyo (JP)

(72) Inventors: Katsumi Yamada, Nagano (JP); Katsuhito Suzuki, Nagano (JP); Tomohiro Yasufuku, Nagano (JP); Nobuhisa Nomoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/582,577

(22) Filed: Dec. 24, 2014

(65) Prior Publication Data

US 2015/0174923 A1 Jun. 25, 2015

(30) Foreign Application Priority Data

Dec. 25, 2013 (JP) ..... 2013-266619
Dec. 25, 2013 (JP) ..... 2013-266620
Dec. 25, 2013 (JP) ..... 2013-266621

(51) Int. Cl.

| | |
|---|---|
| ***B41J 2/01*** | (2006.01) |
| ***B41J 11/00*** | (2006.01) |
| ***B41J 3/407*** | (2006.01) |
| ***B41J 13/10*** | (2006.01) |

(52) U.S. Cl.

CPC ..... *B41J 11/007* (2013.01); *B41J 3/407* (2013.01); *B41J 13/103* (2013.01)

(58) Field of Classification Search

CPC ..... B41J 3/36; B41J 13/103; B41J 15/04
USPC ..... 347/16, 101, 104, 105, 109
See application file for complete search history.

(56) References Cited

U.S. PATENT DOCUMENTS

| | | | | |
|---|---|---|---|---|
| 7,470,019 | B2 * | 12/2008 | Silverbrook et al. | 347/104 |
| 8,243,346 | B2 * | 8/2012 | Suzuki | 358/474 |
| 2009/0103145 | A1 | 4/2009 | Suzuki | |
| 2011/0228236 | A1 * | 9/2011 | Yanagita | 355/18 |

FOREIGN PATENT DOCUMENTS

| | | | |
|---|---|---|---|
| JP | 2007-130769 | A | 5/2007 |
| JP | 2009-096100 | A | 5/2009 |
| JP | 2013-166390 | A | 8/2013 |

* cited by examiner

*Primary Examiner* — An Do
(74) *Attorney, Agent, or Firm* — Globa IP Counselors, LLP

(57) ABSTRACT

A printer includes a device main body, a recording section, and a mounting section. The recording section is provided at the device main body and configured to record on a first recording medium and a second recording medium having lenticular lenses. The mounting section is configured to selectively mount a first conveyance unit configured to convey the first recording medium and a second conveyance unit configured to convey the second recording medium.

19 Claims, 28 Drawing Sheets

RECORDING DEVICE

CROSS-REFERENCE TO RELATED APPLICATIONS

This application claims priority to Japanese Patent Application No. 2013-266619 filed on Dec. 25, 2013, Japanese Patent Application No. 2013-266620 filed on Dec. 25, 2013, and Japanese Patent Application No. 2013-266621 filed on Dec. 25, 2013. The entire disclosures of Japanese Patent Application Nos. 2013-266619, 2013-266620, and 2013-266621 are hereby incorporated herein by reference.

BACKGROUND

1. Technical Field

The present invention relates to a recording device.

2. Related Art

There is a recording device that forms a print image on a lens sheet equipped with a lenticular lens on which a plurality of convex lenses are arranged so that the print image can be seen as a three-dimensional image when the lens sheet is viewed from the lenticular lens side. For example, Japanese Unexamined Patent Application Publication No. 2009-96100 discloses a recording device dedicated for forming a print image by ejecting an ink onto a lens sheet equipped with a lenticular lens.

However, in a recording device dedicated for forming a print image on a lens sheet as shown in Japanese Unexamined Patent Application Publication No. 2009-96100, since a printable recording medium is limited, the manufacturing cost as a recording device increases.

For example, Japanese Unexamined Laid-open Patent Application Publication No. 2007-130769 discloses a recording device in which a typical recording medium such as a printing paper is conveyable and another member can be attached to the back side to convey a lens sheet.

Also, Japanese Unexamined Patent Application Publication No. 2013-166390 discloses a recording device equipped with a paper cassette at a bottom section of the device main body to form a print image on a lens sheet.

However, in the recording device of Japanese Unexamined Laid-open Patent Application Publication No. 2007-130769, because of the structure in which another member is attached to the back side, there is a problem that the recording device is increased in size. There is also a problem that a recording medium cannot be supplied from the front side of the recording device.

Also, the recording device of Japanese Unexamined Patent Application Publication No. 2013-166390 is provided with a conveyance route extending from the bottom section of the device main body where the paper cassette is arranged toward the top section and further curving toward the recording section side. Therefore, since a lens sheet having a lenticular lens formed with a resin does not flexibly bend, the lens sheet may stop in the curved conveyance route or the lens sheet may be damaged. For this reason, there is a problem that a print image cannot be formed on a lens sheet using a recording device having a paper cassette.

SUMMARY

The present invention was made to solve at least a part of the abovementioned problems and can be realized as the following embodiments or applied examples.

A recording device according to one aspect of the invention includes a device main body, a recording section for recording on a first recording medium and a second recording medium having higher rigidity than the first recording medium, a mounting section for mounting a conveyance device which makes the first recording medium and the second recording medium conveyable, a first recording medium storage section for storing the first recording medium, and a first conveyance device having a curved inversion path for inverting the first recording medium fed from the first recording medium storage section in a curved manner and guiding it to the recording section, in which components of the curved inverting path are unitized and detachably attached to the mounting section. A second conveyance device capable of linearly conveying the second recording medium is mounted on the mounting section, and recording on the second recording medium is performed by the recording section.

According to the aspect, the first conveyance device is provided. The first conveyance device has a curved inverting path for inverting the first recording medium fed from the first recording medium storage section in a curved manner and guiding the first recording medium to the recording section. The components of the curved inverting path are unitized and the first conveyance device is detachably attached to the mounting section. The second conveyance device capable of linearly conveying the second recording medium is mounted on the mounting section, and recording on the second recording medium is performed by the recording section. Therefore, the recording device can convey the first recording medium and the second recording medium having higher rigidity than the first recording medium without being increased in size.

In the abovementioned recording device according to the aspect of the invention, the second conveyance device conveys a tray for placing the second recording medium thereon.

According to the aspect, by conveying the second recording medium with the second recording medium placed on the tray, the positional changes of the second recording medium can be controlled.

In the abovementioned recording device according to the aspect of the invention, the second recording medium is conveyed from the front side or the back side of the device.

According to the aspect, it becomes possible to increase the options for the user in the direction in which the second recording medium is supplied inside the device main body from the outside and also becomes possible to control the recording device from being increased in size.

The abovementioned recording device according to the aspect of the invention is equipped with a liquid ejection head for ejecting a liquid provided at the recording section and a supporting member having a supporting surface for supporting the second recording medium or the tray at a position facing the liquid ejection head, and at the time of mounting the second conveyance device, a conveyance surface of the second conveyance unit and the supporting surface of the supporting member are formed so as to be approximately the same surface.

According to this aspect, since the second recording medium is conveyed without being bent, the second recording medium will not be damaged or stopped on the conveyance surface or the supporting surface.

In the abovementioned recording device according to the aspect of the invention, the second conveyance device is equipped with a press roller for pressing the second recording medium or the tray.

According to the aspect, the movement of the second recording medium can be controlled.

In the abovementioned recording device according to the aspect of the invention, the second conveyance device is equipped with a conveyance driving roller for conveying the second recording medium.

According to this aspect, the second recording medium can be conveyed to the recording section side.

In the abovementioned recording device according to the aspect of the invention, the conveyance driving roller is driven by a driving force for driving the first recording medium.

According to this aspect, since a driving mechanism for generating a driving force for driving the conveyance driving roller is not required to be separately provided, the recording device can be controlled from being increased in size.

In the abovementioned recording device according to the aspect of the invention, the second conveyance device is equipped with a guide section for controlling a position of an end portion of the second recording medium in a direction intersecting with the conveyance direction of the second recording medium and guiding the conveyance direction of the second recording medium.

According to this aspect, the quality of an image formed on the second recording medium can be controlled from being deteriorated.

In the abovementioned recording device according to the aspect of the invention, the second conveyance device is equipped with engaging sections to be engaged with an irregular portion of the second recording medium in a direction intersecting with the conveyance direction of the second recording medium.

According to this aspect, the position of the second recording medium can be determined in a direction intersecting with the conveyance direction of the second recording medium.

In the abovementioned recording device according to the aspect of the invention, the first conveyance device conveys the first recording medium in which a recording face is in an inverted state.

According to this aspect, the recording face of the first recording medium can be inverted using the first conveyance device.

In the abovementioned recording device according to the aspect of the invention, the second recording medium has a structure for forming a stereoscopically visible image by parallax variation.

According to this aspect, a stereoscopically visible image by parallax variation can be formed on the second recording medium using the recording device.

In the abovementioned recording device according to the aspect of the invention, the first conveyance device has a second recording medium storage section for storing the first recording medium in an inclined state and is provided with a conveyance route for conveying the first recording medium from the second recording medium storage section to the recording section.

According to this aspect, it becomes possible to increase the options for the user in the direction in which the second recording medium is supplied inside the device main body from the outside and also becomes possible to control the recording device from being increased in size.

A recording device according to another aspect of the invention includes a recording section configured to record an image on a first recording medium and a second recording medium, a recording medium storage section configured to store the first recording medium, and a curved route conveyance section having a curved route configured to convey the first recording medium fed from the recording medium storage section side. An opening portion capable of inserting the second recording medium is provided in the curved route conveyance section. The opening portion is provided at a position of the second recording medium at the time of recording by the recording section in the vertical direction, and a linear conveyance route for linearly conveying the recording medium is provided between the opening portion and the abovementioned position.

According to this aspect, the opening portion is provided at the position of the second recording medium at the time of recording by the recording section in the vertical direction, and the linear conveyance route for linearly conveying the recording medium is provided between the opening portion and the position. With this, the second recording medium is conveyed on the linear conveyance route to be recorded by the recording section without being conveyed on the curved route. Therefore, the second recording medium will not stop or be damaged on the curved route. Consequently, since recording can be performed on the first recording medium or the second recording medium, the manufacturing cost of the recording device can be controlled from increasing.

In the abovementioned recording device according to the aspect of the invention, a mounting stand extending in a horizontal direction for mounting the second recording medium is provided on the bottom side of the opening portion in the vertical direction.

According to this aspect, the second recording medium can be conveyed to the recording section side in a stable position.

In the abovementioned recording device according to the aspect of the invention, the extending direction of the mounting stand can be changed to a vertical direction.

According to this aspect, the spatial region occupied by the recording device can be reduced when the mounting stand is not used.

In the abovementioned recording device according to the aspect of the invention, the mounting stand is equipped with engaging sections to be engaged with an irregular portion of the second recording medium in a direction intersecting with the conveyance direction of the second recording medium.

According to this aspect, the position of the second recording medium can be determined in a direction intersecting with the conveyance direction of the second recording medium.

In the abovementioned recording device according to the aspect of the invention, the curvature of the second recording medium when conveyed on the linear conveyance route is less than the curvature of the first recording medium when conveyed on the curved route conveyance portion.

According to this aspect, damages to the second recording medium can be controlled.

In the abovementioned recording device according to the aspect of the invention, the mounting stand is equipped with a guide section for controlling a position of an end portion of the second recording medium in a direction intersecting with the conveyance direction of the second recording medium and guiding the conveyance direction of the second recording medium.

According to this aspect, the quality of an image formed on the first recording medium can be controlled from being deteriorated.

In the abovementioned recording device according to the aspect of the invention, the second recording medium is mounted on a tray to be conveyed.

According to this aspect, by conveying the second recording medium with the second recording medium placed on the tray, the positional changes of the second recording medium can be controlled.

In the abovementioned recording device according to the aspect of the invention, an end portion detecting section for detecting end portions of the first recording medium and the second recording medium in the conveyance direction is provided. An end portion of the tray in the conveyance direction is detected by the end portion detecting section.

According to this aspect, since an end portion detecting section for detecting an end portion of the tray in the conveyance direction is not required to be separately provided, an increase in manufacturing cost can be restrained.

In the abovementioned recording device according to the aspect of the invention, the curved route conveyance section conveys the first recording medium in which a recording face is in an inverted state.

According to this aspect, the recording face of the first recording medium can be inverted using the curved route conveyance section.

In the abovementioned recording device according to the aspect of the invention, the second recording medium has a structure for forming a stereoscopically visible image by parallax variation.

According to this aspect, a stereoscopically visible image by parallax variation can be formed on the second recording medium using the recording device.

The abovementioned recording device according to another aspect of the invention includes a recording section configured to record an image to a first recording medium and a second recording medium, a recording medium storage section configured to store the first recording medium, a housing provided with a mounting section and for storing the recording section and the recording medium storage section, a curved route conveyance section detachably provided at a mounting section of the housing and having a curved route, the curved route conveyance section conveying the first recording medium fed from the recording medium storage section side to the recording section side, and a linear conveyance route configured to linearly convey the second recording medium in a state in which the curved route conveyance section is removed from the housing.

According to this aspect, in a state in which the curved route conveyance section is removed from the housing, a linear conveyance route configured to linearly convey the second recording medium is provided. With this, the second recording medium is conveyed on the linear conveyance route to be recorded by the recording section without being conveyed on the curved route. Therefore, the second recording medium will not stop or be damaged on the curved route. Consequently, since recording can be performed on the first recording medium or the second recording medium, an increase in manufacturing cost of the recording device can be restrained.

The abovementioned recording device according to the aspect of the invention is provided with a recording medium storage section for storing the first recording medium and a feeding roller for feeding the first recording medium stored in the recording medium storage section to the curved route conveyance section side, in which the second recording medium is conveyed by the feeding roller.

According to this aspect, since the feeding roller for feeding the first recording medium to the curved route conveyance section side can be commonly used, an increase in manufacturing cost can be restrained.

In the abovementioned recording device according to the aspect of the invention, the linear conveyance route is equipped with a guide section for controlling a position of an end portion of the second recording medium in a direction intersecting with the conveyance direction of the second recording medium and guiding the conveyance direction of the second recording medium.

According to this aspect, the quality of an image formed on the second recording medium can be controlled from being deteriorated.

In the abovementioned recording device according to the aspect of the invention, the second recording medium is mounted on a tray to be conveyed.

According to this aspect, by conveying the second recording medium with the second recording medium placed on the tray, the positional changes of the second recording medium can be controlled.

In the abovementioned recording device according to the aspect of the invention, the linear conveyance route is equipped with engaging sections to be engaged with an irregular portion of the second recording medium in a direction intersecting with the conveyance direction of the second recording medium.

According to this aspect, the position of the second recording medium can be determined in a direction intersecting with the conveyance direction of the second recording medium.

In the abovementioned recording device according to the aspect of the invention, the curved route conveyance section conveys the first recording medium in which a recording face is in an inverted state.

According to this aspect, the recording face of the first recording medium can be inverted using the curved route conveyance section.

In the abovementioned recording device according to the aspect of the invention, the second recording medium has a structure for forming a stereoscopically visible image by parallax variation.

According to this aspect, a stereoscopically visible image by parallax variation can be formed on the second recording medium using the recording device.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1A:
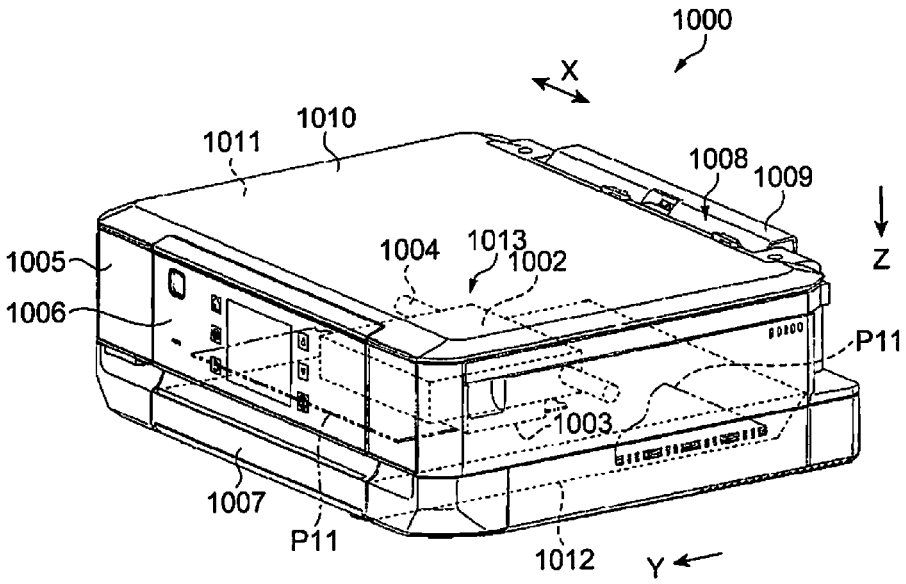
FIGS. 1A and 1B are external perspective views of a recording device according to a first embodiment.
Figure 1B:
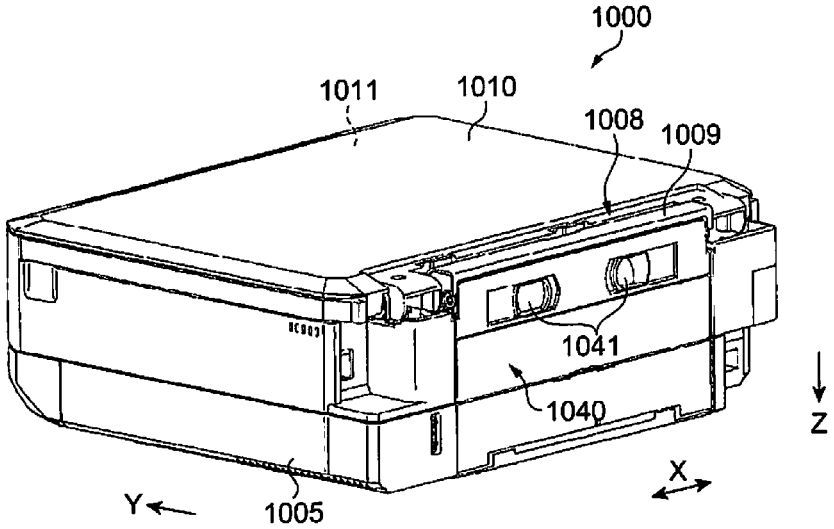

Hereinafter, the recording device according to a first embodiment will be explained with reference to the drawings. FIG. 1A is an external perspective view of a recording device 1000 of this embodiment as seen from the front side. FIG. 1B is an external perspective view of the recording device 1000 of this embodiment as seen from the back side. The recording device 1000 is provided, in a housing 1005 having an approximately rectangular parallelepiped shape surrounded by a plurality of frames, with a recording section 1013 configured to record an image by ejecting an ink. The recording section 1013 is equipped with a liquid ejection head 1003 for ejecting an ink and includes a carriage 1002 that is reciprocated in the main scanning direction X along a guide member 1004 in accordance with the drive of a carriage motor (not illustrated).

On the front side of the housing 1005, an operation panel 1006 for operating the recording section 1013 is arranged. On the upper surface side of the operation panel 1006 in the vertical direction Z, an image reading section 1011 is arranged. A user can make the recording device read an image by rotating a cover 1010 provided on the top section of the housing 1005 and placing a manuscript, etc., as an object to be read on the manuscript stand (not illustrated).

The operation panel 1006 is equipped with a display section (e.g., a liquid crystal display) for displaying a menu screen or the like, an operation section (e.g., an operation button). The operation panel 1006 is configured so that the lower side thereof can be lifted forwardly to be opened by the rotation mechanism such as a hinge provided on the upper side and is openably/closably attached to the housing 1005.

Below the recording section 1013, a paper cassette 1012 for placing papers P11 thereon in a stacked state is provided. Below the operation panel 1006, a front lid portion 1007 is rotatably provided with the bottom section secured as a fulcrum, so that the paper cassette 1012 is insertably/removably provided in the housing 1005 in a state in which the front lid portion 1007 is rotated forward and opened. The paper P11 placed on the paper cassette 1012 is fed to the recording section 1013 and recorded, then discharged to the downstream side in the sub-scanning direction Y (hereinafter referred to as "downstream side").

Figure 2A:
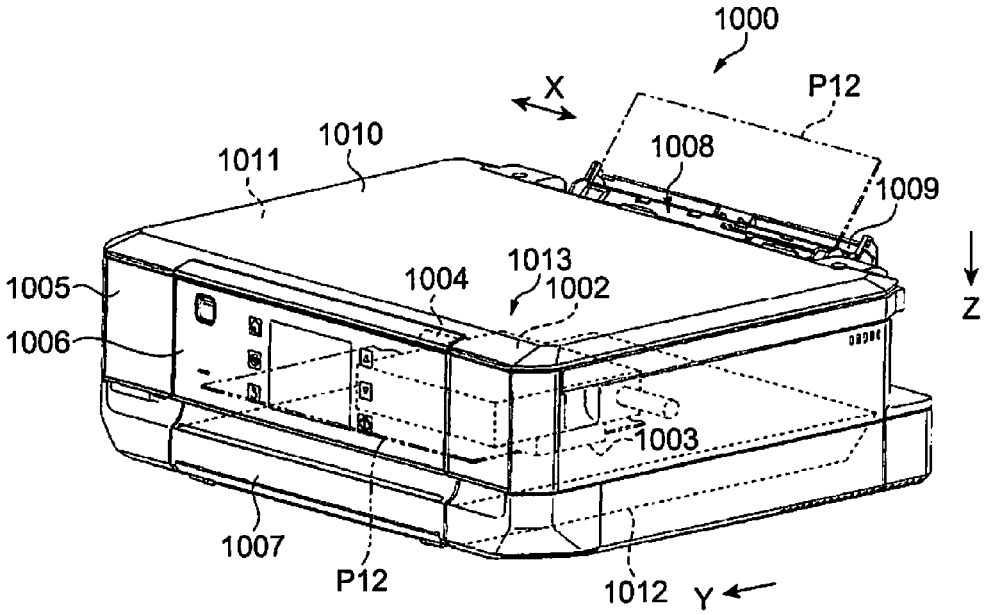
FIGS. 2A and 2B are external perspective views of the recording device according to the first embodiment.
Figure 2B:
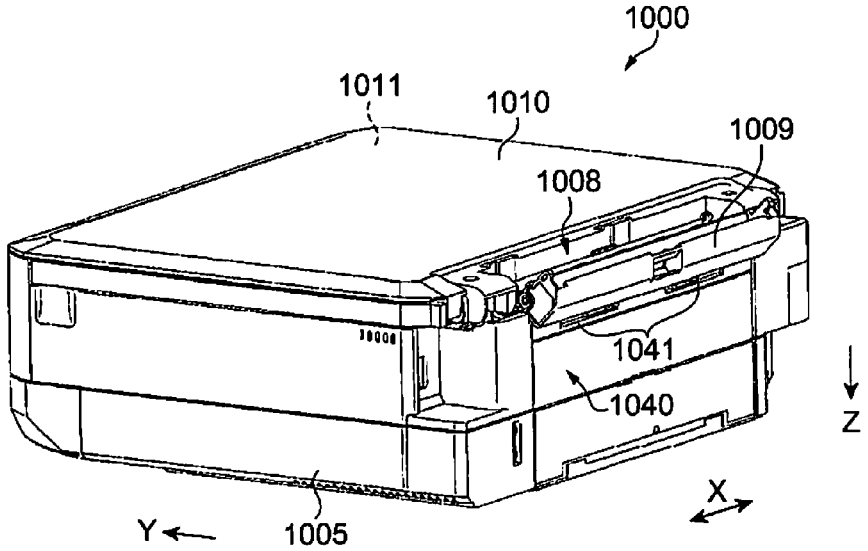

FIGS. 2A and 2B each show a state in which the opening/closing lid 1009 provided at the back side top section of the recording device 1000 is rotated and open. A user rotates the opening/closing lid 1009 and inserts a paper P12 one by one from the feeder opening 1008 by hand. The paper P12 inserted from the feeder opening 1008 is fed to the recording section 1013, recorded, and discharged to the downstream side.

Figures 3A, 3B, 3C:
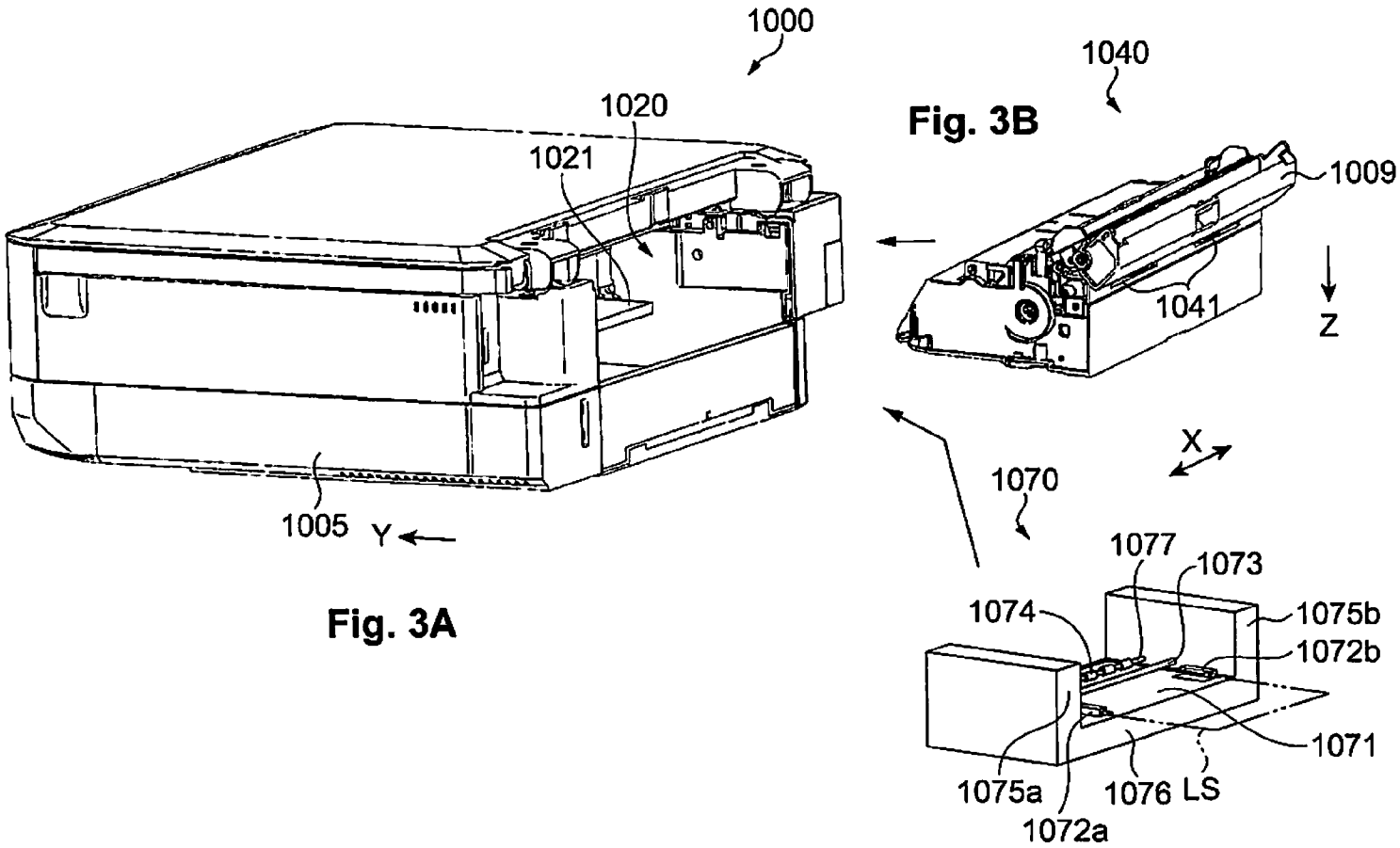
FIG. 3A is a perspective view of the recording device in a state in which a paper inversion unit is removed.
FIG. 3B is a perspective view of the paper inversion unit.
FIG. 3C is a perspective view of a lens sheet feeder unit.

FIG. 3A is a perspective view of the recording device 1000 as seen from the back side thereof in a state in which the paper inversion unit 1040 is removed backwards from the mounting section 1020 provided in the housing 1005. FIG. 3B is a perspective view of the paper inversion unit 1040.

Above the paper cassette 1012 on the back side of the recording device 1000, the paper inversion unit 1040 equipped with a paper inversion mechanism is detachably provided with respect to the mounting section 1020. The paper inversion unit 1040 includes a conveyance route for conveying the paper P11 placed on the paper cassette 1012 of FIG. 1A toward the recording section 1013 and for conveying the paper P12 inserted from the feeder opening 1008 of FIG. 2A toward the recording section 1013.

Further, the conveyance route of the paper inversion unit 1040 functions as a conveyance route for inverting the front and rear surfaces of a paper P, that is, for inverting the recording surfaces to perform recording on both surfaces of the papers P11 and P12 to be fed to the recording section 1013.

The paper inversion unit 1040 is provided with a pair of operation sections 1041 which move slidingly in the main scanning direction X when the user inserts fingertips and performs a gripping operation. When the user slidingly moves the operation sections 1041 so as to approach each other, the locked state to the housing 1005 is released, thereby allowing the paper inversion unit 1040 to be removed backward from the housing 1005.

Figure 4:
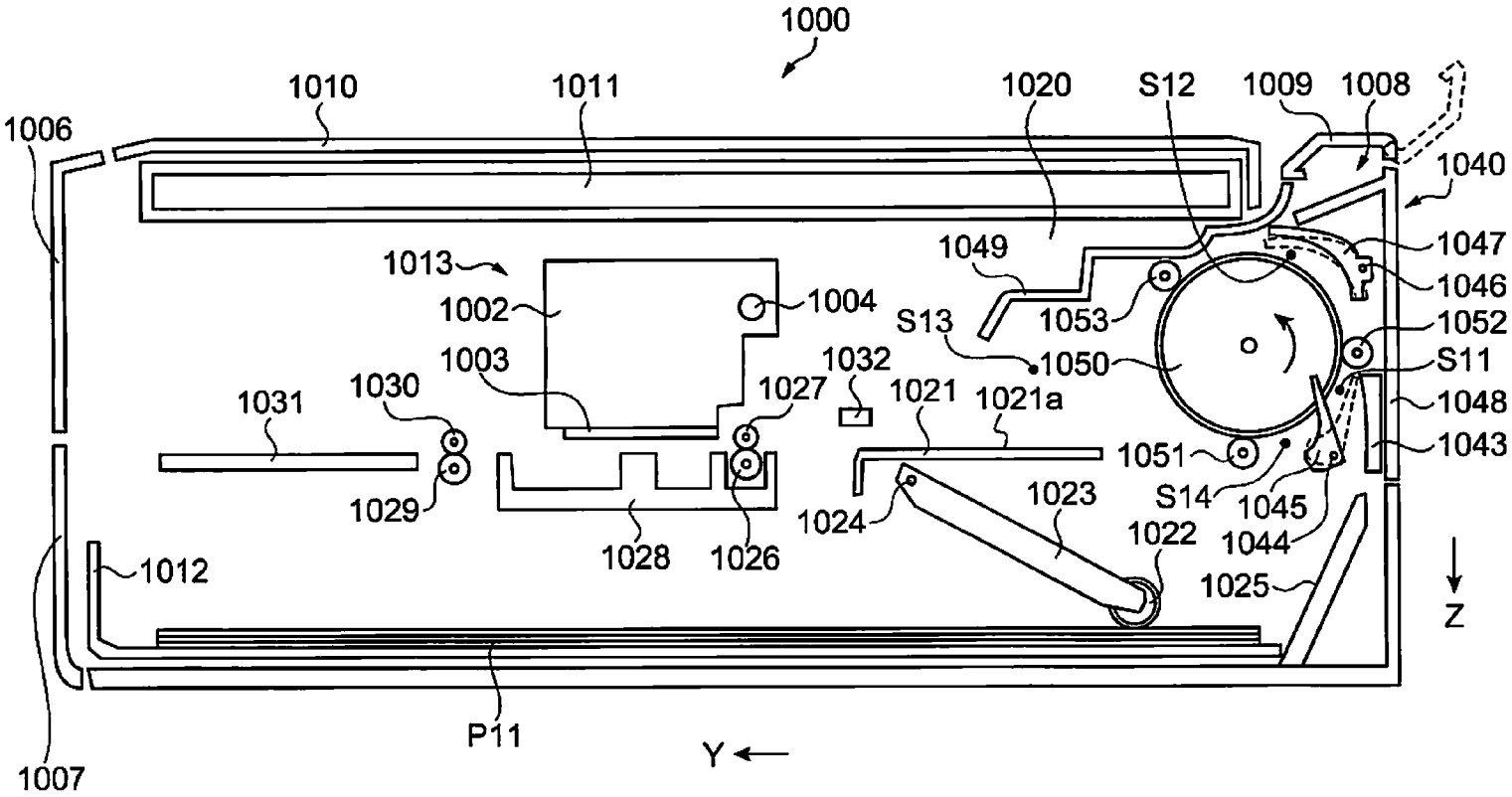
FIG. 4 is a cross-sectional view showing a schematic configuration of the recording device in a state in which the paper inversion unit is mounted thereon.

FIG. 4 is a cross-sectional view illustrating the schematic configuration of the recording device 1000 as seen from the main scanning direction X in a state in which the paper inversion unit 1040 is mounted in the mounting section 1020. Above the recording section 1013, an image reading section 1011 equipped with a cover 1010 on the top section is arranged. Below the mounting section 1020, a feeding roller 1022 supported by a swinging member 1023, which swings about a rotational axis 1024 as a fulcrum, is provided.

The housing of the paper inversion unit 1040 includes a back side wall section 1048 and a top wall section 1049. The paper inversion unit 1040 includes an intermediate conveyance driving roller 1050, driven rollers 1051, 1052 and 1053 driven by the driving rotation of the intermediate conveyance driving roller 1050, a swinging member 1045 which swings about a rotational axis 1044 as a fulcrum, and a swinging member 1047 which swings about a rotational axis 1046 as a fulcrum. Also, the paper inversion unit 1040 includes a wall member 1043 provided between the back side wall section 1048 and the swinging member 1045, the opening/closing lid 1009, and members constituting the feeder opening 1008.

The paper P11 placed on the paper cassette 1012 is fed to the conveyance path S11, which is a spatial region formed between the wall member 1043 and the swinging member 1045 shown by a solid line, via a separating slanted surface 1025 by the driving rotation of the feeding roller 1022. The paper P11 pinched by and between the intermediate conveyance driving roller 1050 driven and rotating in the direction of the arrow and the driven rollers 1052 and 1053 is conveyed to a conveyance path S13, which is a spatial region formed between the top wall section 1049 and a wall section 1021 provided in the recording device 1000 via the conveyance path S12, which is a spatial region between the swinging member 1047 shown by a solid line and the intermediate conveyance driving roller 1050, and then conveyed along a conveyance surface 1021*a* formed on the top section of the wall section 1021.

The paper P11 conveyed along the conveyance surface 1021*a* is pinched by a conveyance driving roller 1026 which is driven and rotated and a driven roller 1027 which is driven by the driving rotation of the conveyance driving roller 1026, and then conveyed to the downstream side in a manner in which a position facing the liquid ejection head 1003 is supported by a supporting member 1028.

The liquid ejection head 1003 which is reciprocated in the main scanning direction X ejects an ink on the conveyed paper P11 to record an image. The paper P11 is pinched by and between a discharge driving roller 1029 and a driven roller 1030 which is driven by the driving rotation of the discharge driving roller 1029, conveyed to the downstream side along the top surface of a conveyance path forming member 1031, and then discharged from the opening section formed when the front lid portion 1007 is rotated.

In a state in which the opening/closing lid 1009 is rotated to the back side as shown by the broken line, when the paper P12 of FIG. 2A is inserted from the feeder opening 1008, the tip end section of the swinging member 1047 rotates downward as shown by the broken line, thereby opening the intermediate conveyance driving roller 1050 side of the feeder opening 1008.

The paper P12 is pinched by and between the intermediate conveyance driving roller 1050 which is driven and the driven roller 1053, and then conveyed to the conveyance path S13. Then, an image is recorded in the recording section 1013 while the paper P12 is conveyed by the conveyance driving roller 1026 and the driven roller 1027 and the paper P12 is discharged from the opening section formed by the rotation of the front lid portion 1007.

Next, the operation in which the papers P11 and P12 are inverted by the paper inversion unit 1040 and recording is performed on both surfaces, the front surface and the back surface, of the papers P11 and P12 will be explained. The paper P11 conveyed from the paper cassette 1012 via the conveyance paths S11 and S12 and the paper P12 inserted from the feeder opening 1008 are conveyed to the downstream side by the intermediate conveyance driving roller 1050 and the driven roller 1053. At this point, the papers P11 and P12 are each conveyed by the conveyance driving roller 1026 and the driven roller 1027 in a state in which the surface faces upward or to the liquid ejection head 1003 side and an image is recorded on the front surface of the paper P11 and P12 in the recording section 1013.

Then, the paper P11 and P12 on which an image was recorded on the surface, is conveyed to the upstream side (hereinafter referred to as "upstream side") in the sub-scanning direction Y by the reversing rotation of the conveyance driving roller 1026, and then conveyed to the conveyance path S14 which is a spatial region between the driven roller 1051 and the swinging member 1045 by the intermediate conveyance driving roller 1050 which is driven in the direction of the arrow and the driven roller 1051.

As shown by the broken line, the tip end section of the swinging member 1045 rotates to the back side and the paper P11 and P12 is conveyed to the conveyance path S11. Then, the paper P11 and P12 is conveyed via the conveyance paths S12 and S13 by the intermediate conveyance driving roller 1050 and the driven rollers 1052 and 1053. At this point, the paper P11 and P12 is conveyed to the downstream side along the conveyance surface 1021*a* in a state in which the back surface faces upward, conveyed by the conveyance driving roller 1026 and the driven roller 1027, and an image is recorded on the back surface of the paper P11 and P12 in the recording section 1013.

On the upstream side of the liquid ejection head 1003, for example, an optical end portion detecting section 1032 for detecting an upstream side and downstream side end portion the of the paper P11 and P12 is provided.

Figure 5:
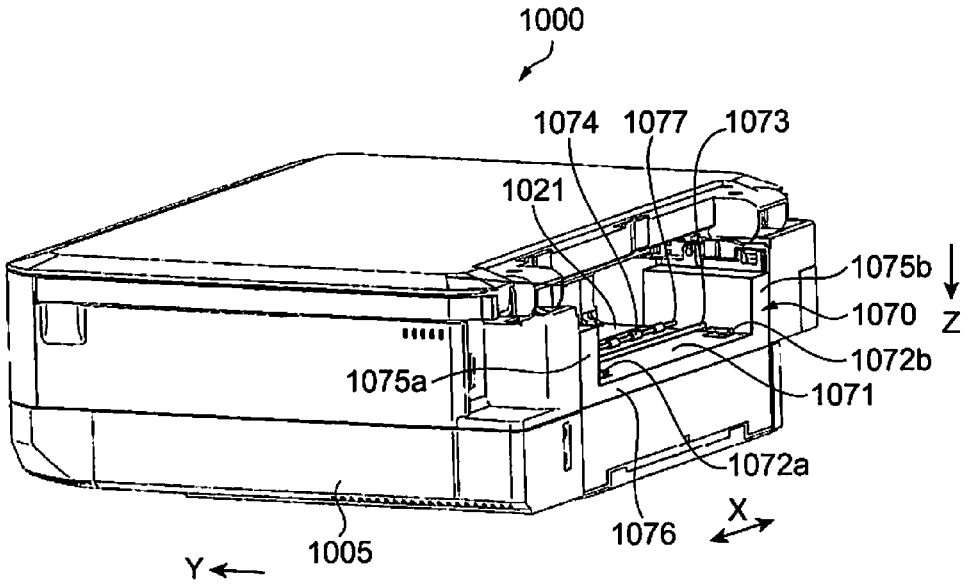
FIG. 5 is an external perspective view of the recording device in a state in which a lens sheet feeder unit is mounted thereon.

FIG. 3C is a perspective view of the lens sheet feeder unit 1070. FIG. 5 is an external perspective view of the recording device 1000 as seen from the back side in a state in which the lens sheet feeder unit 1070 is mounted in the mounting section 1020 provided in the housing 1005. The lens sheet feeder unit 1070 of FIG. 3C can be detachably mounted in the mounting section 1020.

The paper inversion unit 1040 of FIG. 3B or the lens sheet feeder unit 1070 of FIG. 3C is detachably mounted in the mounting section 1020 of FIG. 3A. That is, when either one of the paper inversion unit 1040 or the lens sheet feeder unit 1070 is mounted in the mounting section 1020, the other is in a state removed from the mounting section 1020.

Figure 8A:
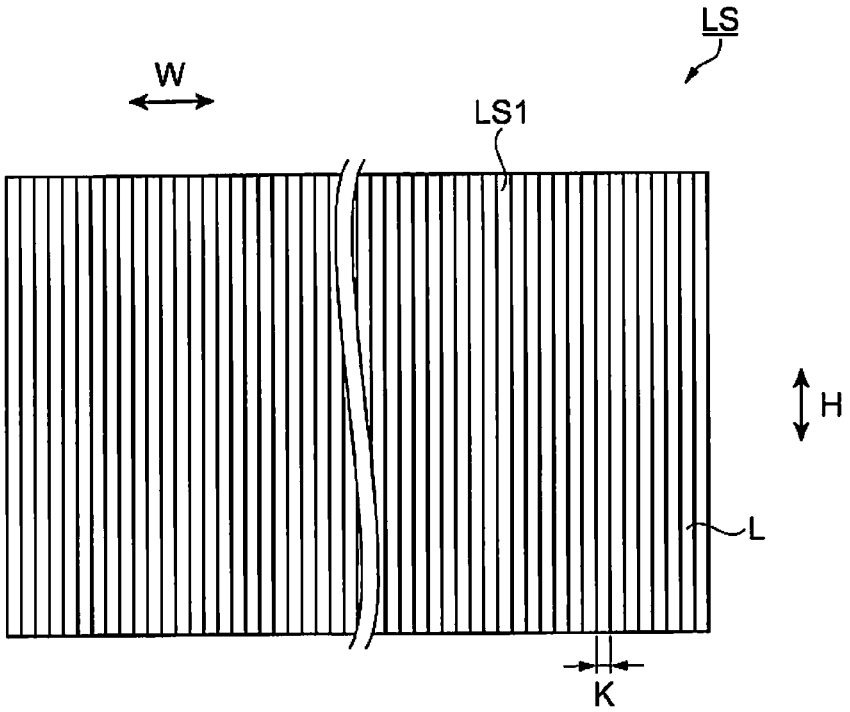
FIG. 8A is a view showing the lens sheet from a lenticular lens side.

Here, the lens sheet LS will be explained. FIG. 8A is a view of a lens sheet LS seen from the lenticular lens LS1 side. The lenticular lens LS1 is configured so that a plurality of cylindrical convex lenses L (hereinafter referred to as "lens L") in which the direction H is denoted as a longitudinal direction are arranged in a parallel manner in a widthwise direction W at a constant pitch K.

Figure 8B:
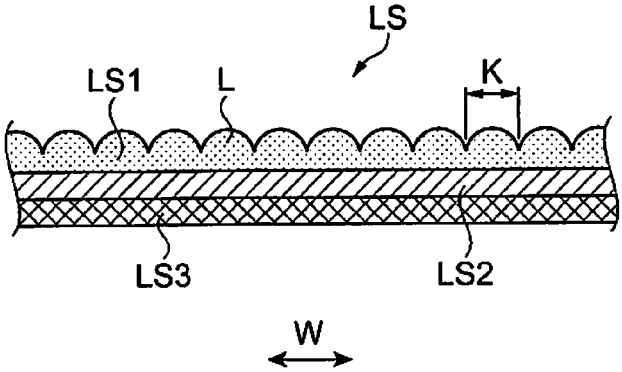
FIG. 8B is a cross-sectional view showing a schematic configuration of the lens sheet.

FIG. 8B is a cross-sectional view showing a schematic configuration of the lens sheet LS as seen from the direction H. The lens sheet LS is equipped with a lenticular lens LS1 positioned on the front surface, an ink absorbing layer LS2 in contact with the back surface of the lenticular lens LS1, and an ink permeable layer LS3 positioned on the back surface of the lens sheet LS. In the lenticular lens LS1, the curvature of the lens L is configured so that the focal point of the light progressing through each lens L is positioned on the back surface of the lenticular lens LS1.

The ink permeable layer LS3 is a section where an ink drop ejected from an unillustrated nozzle first adheres and the adhered ink permeates. The ink permeable layer LS3 is formed with material such as, e.g., titanium oxide, silica gel, minute particles of PMMA (methacrylic resin) or the like, barium sulfate, glass fiber, and plastic fiber. Also, the ink absorbing layer LS2 is a portion configured to absorb and fix the ink permeated the ink permeable layer LS3. The ink absorbing layer LS2 is formed with materials such as, e.g., a hydrophilic polymer resin such as PVA (polyvinyl alcohol), cationic compound, and minute particles such as silica. Also, the lenticular lens LS1 is formed with material such as, e.g., PET, PETG, APET, PP, PS, PVC, acryl, and UV resin.

Also, the ink absorbing layer LS2 is transparent and the ink permeable layer LS3 is colored white. However, the ink absorbing layer LS2 can be white and the ink permeable layer LS3 can be transparent and further, both the ink permeable layer LS3 and the ink absorbing layer LS2 can be transparent. Also, in this embodiment, because of the existence of the ink permeable layer LS3, the lens sheet LS can be touched immediately after printing. However, the lens sheet LS can have a configuration in which the ink permeable layer LS3 is not provided.

Also, as shown in FIG. 8A, the lens sheet LS of this embodiment has a rectangular external appearance and both end portions of the lens sheet LS in the widthwise direction W (edge portions extending in the direction H) are parallel to the longitudinal direction of the lens L.

Figure 9A:
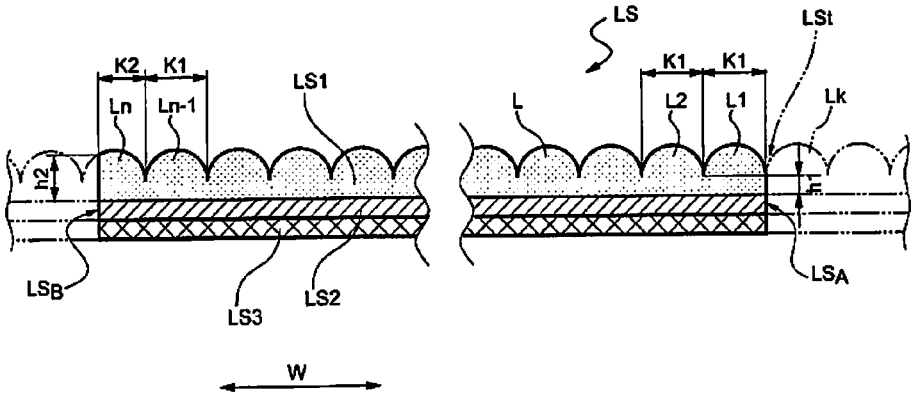
FIG. 9A is a cross-sectional view showing a schematic configuration of the lens sheet.
Figure 9B:
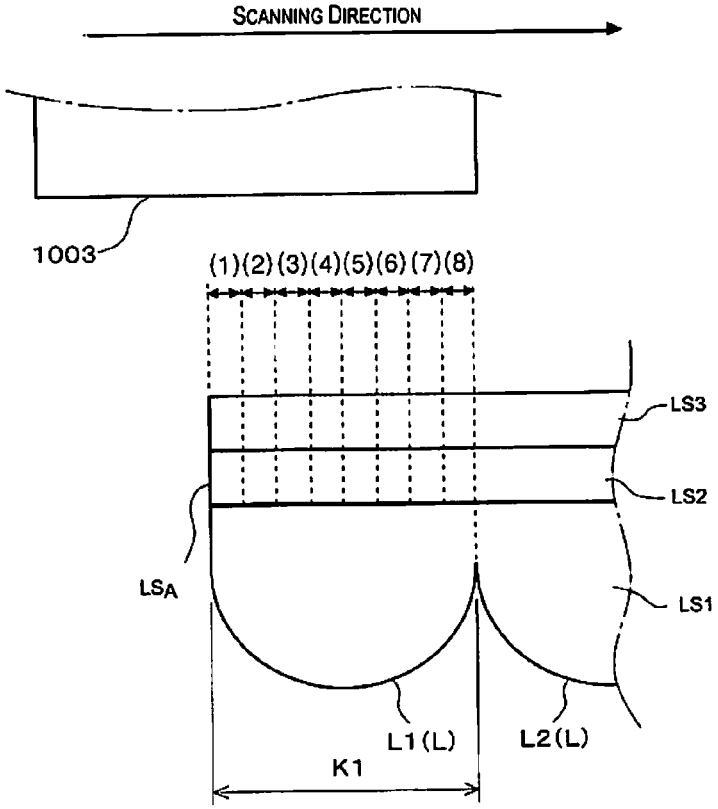
FIG. 9B is a cross-sectional view showing one end side surface of the lens sheet in which an image is recorded.

Next, the edge $LS_A$ on one side and the edge $LS_B$ on the other side of the lens sheet LS in the W direction will be explained. The thickness of the lenticular lens LS1 at the edge $LS_A$ on one side of the lens sheet LS in the W direction is shown by the symbol h1 in FIG. 9 and the width of the lens L1 forming the edge $LS_A$ is shown by the symbol K1. Similarly, the thickness of the lenticular lens LS1 at the edge $LS_B$ on the other side of the lens sheet LS is shown by the symbol h2 in FIG. 9A and the width of the lens Ln forming the edge $LS_B$ is shown by the symbol K2.

A cutting device for forming (cutting) the lens sheet LS and the cutting blade thereof are not omitted. The cutting blade is precisely controlled at a position exactly corresponding to the valley LSt of adjacent lenses LSk in the present invention, so that the cut surface becomes the edge $LS_A$ after cutting is performed. The edge $LS_B$ on the other side is a cut surface formed by cutting without precisely controlling the cutting position.

Therefore, the thickness h1 of the lenticular lens LS1 at the edge $LS_A$ is thinner than the thickness h2 of the lenticular lens LS1 at the edge $LS_B$. Since the thicknesses of each of the layers other than the lenticular lens LS1 are even, the thickness of the edge $LS_A$ as a whole is thinner than the thickness of the edge $LS_B$ as a whole.

Also, the width K1 of the lens L1 forming the edge $LS_A$ is wider than the width K2 of the lens Ln forming the edge $LS_B$ on the other side, and the width K1 of the lens L1 corresponds to the width (K1) of the lens L2 adjacent to the lens L1. In addition, the width K1 of the other lenses L other than the edge is K1.

That is, it is enough to precisely control the cutting position when forming the edge $LS_A$ on one side, and it is not required to strictly control the cutting position when forming the edge $LS_B$ on the other side. Therefore, the increase in the complexity and the cost for the cutting device can be restrained, which in turn can prevent an increase in cost of the lens sheet LS.

To this lens sheet LS, by performing recording with the liquid ejection head 1003 with the precisely cut and formed edge $LS_A$ as a reference, an image to be recorded on one lens L can be prevented from being recorded across other adjacent lens. That is, in the example of FIG. 9B, all of the images (1) to (8) can be accurately recorded on the lens L and therefore an excellent visual effect can be obtained.

Figure 6A:
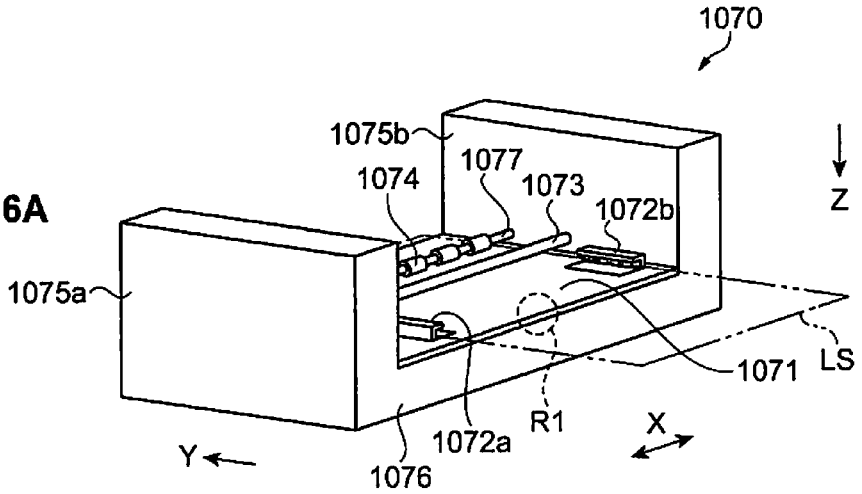
FIG. 6A is a perspective view of the lens sheet feeder unit.

FIG. 6A is a perspective view of the lens sheet feeder unit 1070. The lens sheet feeder unit 1070 is provided with a bottom section 1076 and standing sections 1075*a* and 1075*b* upwardly standing and provided on both sides of the bottom section 1076 in the main scanning direction X.

On both sides of the top section of the bottom section 1076 in the main scanning direction X, edge guides 1072*a* and 1072*b* for controlling the positions of both end sections of the lens sheet LS in the main scanning direction X are slidably provided in the main scanning direction X. The edge guides 1072*a* and 1072*b* are upwardly standing on the bottom section 1076 and shaped so as to extend in the sub-scanning direction Y.

On the top section of the bottom section 1076, a sheet guide 1071 is provided. The sheet guide 1071 is provided within the maximum range in which both end sections of the lens sheet LS are controlled in the main scanning direction X by the edge guides 1072*a* and 1072*b*. Also, the sheet guide 1071 is provided on the top section of the bottom section 1076 in the sub-scanning direction Y from an end section on the front side to the end section on the back side with the exception of the range in which the edge guides 1072*a* and 1072*b* are provided.

Figure 6B:
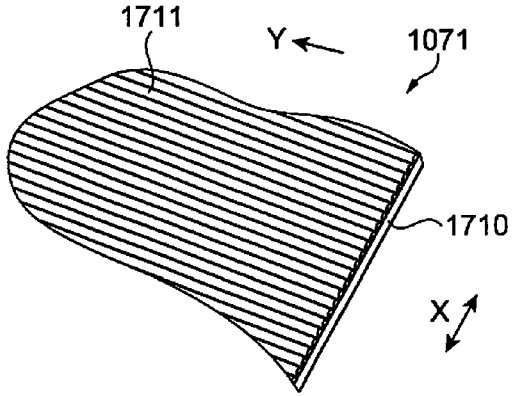
FIG. 6B is a view showing a portion of a sheet guide.
Figure 6C:
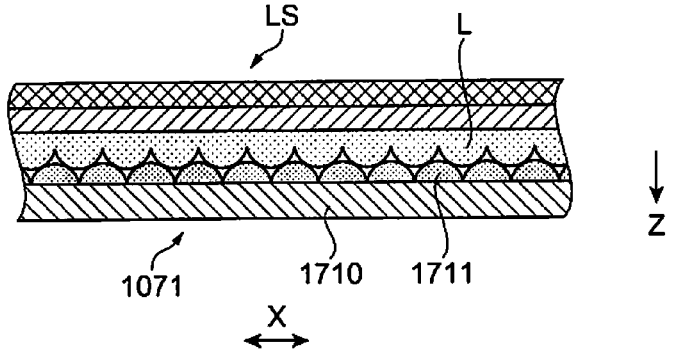
FIG. 6C is a cross-sectional view of the sheet guide and a lens sheet.

FIG. 6B is an enlarged view of the portion of the sheet guide 1071 provided on the top section of the bottom section 1076 within the circle as shown by the broken line R1. FIG. 6C is a cross-sectional view of the sheet guide 1071 and the lens sheet LS placed on the top section of the sheet guide 1071 as seen from the sub-scanning direction Y.

The sheet guide 1071 of FIG. 6C is equipped with a substrate 1710 and a plurality of convex portions 1711. The substrate 1710 is a board-shaped member formed with resin, etc. In this embodiment, the convex portion 1711 is formed into the same shape as the lenticular lens LS1 of the lens sheet LS and formed with the same pitch as the arranged pitch K of the lenticular lens LS1 of FIG. 8B. Also, as shown in FIG. 6B, the convex portions 1711 are continuously formed in a manner as to extend in the sub-scanning direction Y.

In addition, the interval of the convex portions 1711 in the X direction is not always required to be the same lens pitch K of the lenticular lens LS1 and can be the interval of the integer multiple of the lens pitch K.

In this embodiment, the sheet guide 1071 is constituted by adhering the convex portions 1711 made of the same material as the lenticular lens LS1 on the substrate 1710.

Also, when forming the substrate 1710 by resin molding, a mold surface corresponding to the convex portions 1711 can be formed on a molding die in advance and the convex portions 1711 and the substrate 1710 can be formed integrally. In addition, when integrally resin molding the convex portions 1711 on the substrate 1710, by using a resin material having low friction such as a fluororesin, etc., as the resin material forming the substrate 1710, the friction between the lens sheet LS and the convex portion 1711 can be reduced, thereby allowing a smooth conveyance of the lens sheet LS. Also, the substrate 1710 can be formed with a metal board. In that case, the convex portions 1711 can be formed by subjecting the metal board to a cutting process.

Above the bottom section 1076 in FIG. 6A, a feeding roller 1074 provided on the same axis as the rotational shaft 1077 is provided. The rotational shaft 1077 is rotatably provided by bearing portions (not illustrated) provided on the standing sections 1075*a* and 1075*b*.

On the upstream side of the feeding roller 1074 above the bottom section 1076, a press roller 1073 is provided. The press roller 1073 is rotatably provided by bearing portions (not illustrated), in which a positional change is allowed in the vertical direction Z, on the standing sections 1075*a* and 1075*b*.

Figure 7:
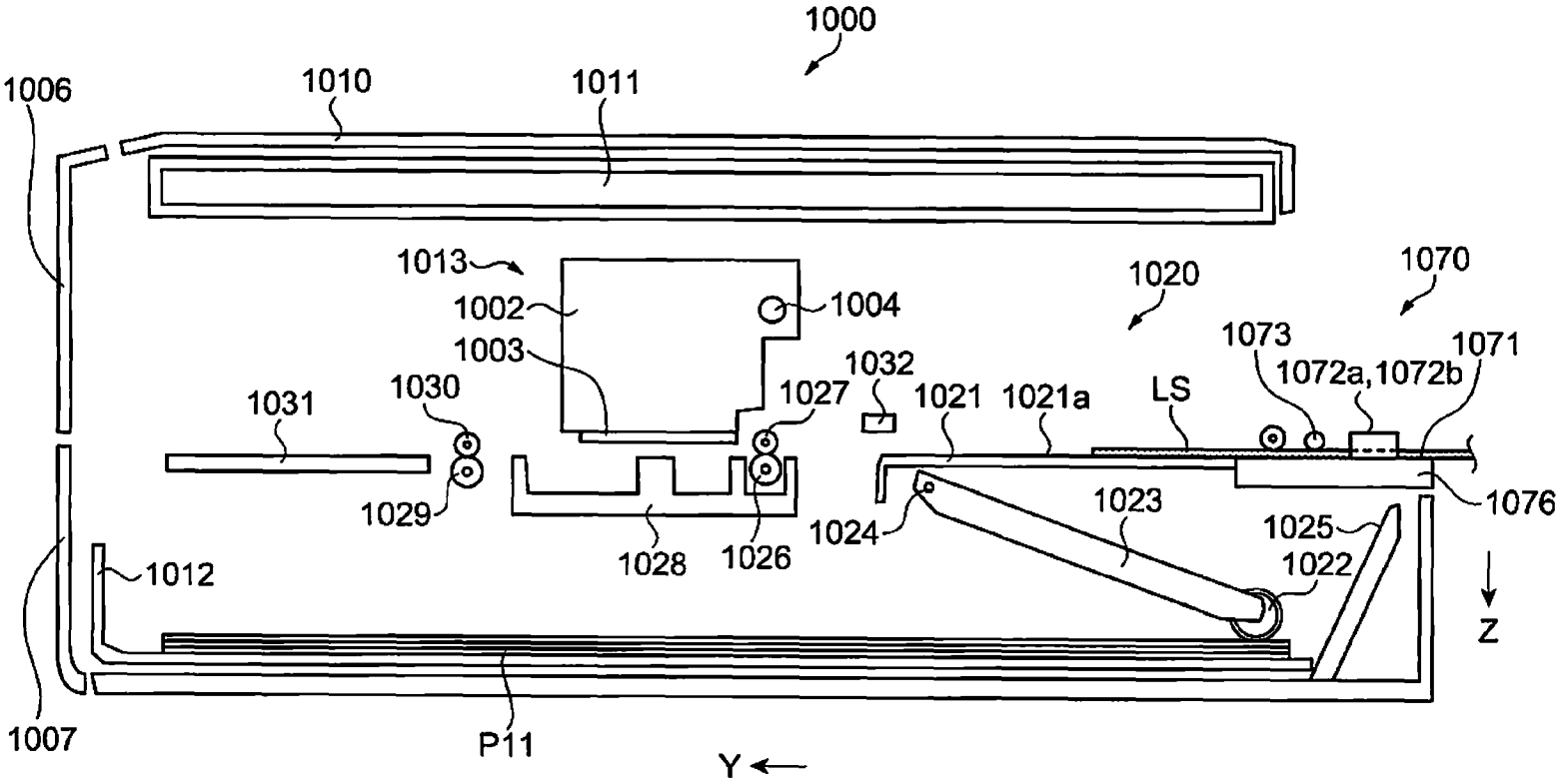
FIG. 7 is a cross-sectional view showing a state in which a lens sheet is fed by the lens sheet feeder unit.

FIG. 7 is a cross-sectional view showing a state in which the lens sheet LS is fed by the lens sheet feeder unit 1070. FIG. 7 illustrates a state in which the paper inversion unit 1040 is removed from the mounting section 1020 and the lens sheet feeder unit 1070 is mounted on the mounting section 1020.

In a state in which the lens sheet feeder unit 1070 is mounted to the mounting section 1020, the rotational shaft 1077 equipped with the feeding rollers 1074 rotates by obtaining a rotational driving force from the transmission mechanism (not illustrated) constituted by a gear, etc. Consequently, the lens sheet LS slides on the sheet guide 71 and is fed to the downstream side.

The press roller 1073 rotates in a state in which the press roller 1073 presses the lens sheet LS sliding on the sheet guide 1071. With this, since the engaged state of the lenticular lens LS1 of the lens sheet LS of FIG. 6C and the convex portions 1711 of the sheet guide 1071 can be maintained, the movement of the lens sheet LS with respect to the sheet guide 1071 can be controlled.

In the sub-scanning direction Y, the end section of the upstream side and the downstream side of the lens sheet LS conveyed toward the downstream side by the feeding rollers 1074 is detected by the end portion detecting section 1032.

Furthermore, an image is recorded with the recording section 1013 and the lens sheet LS is discharged from the opening section formed by the rotation of the front lid portion 1007.

Figure 11:
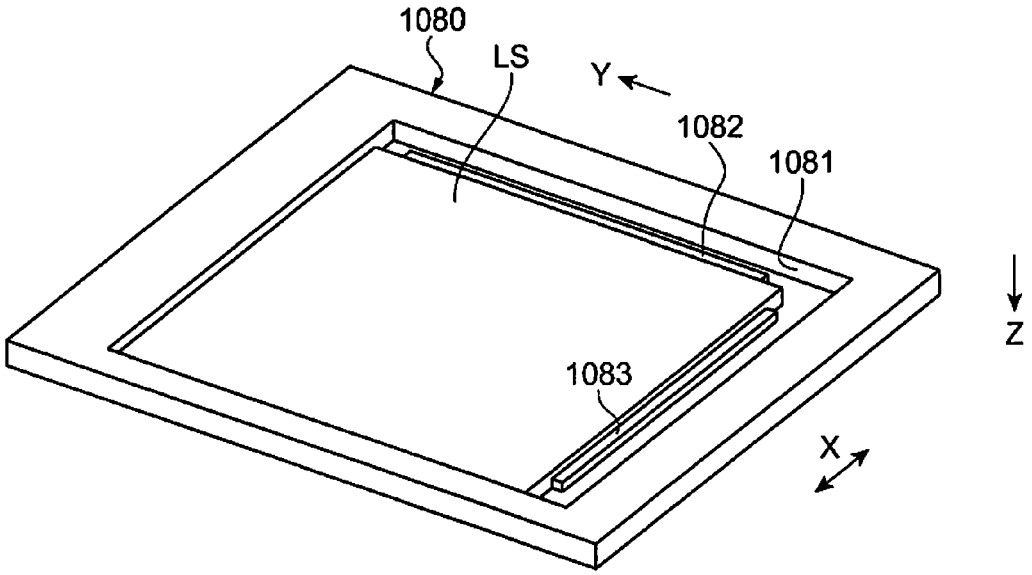
FIG. 11 is a view showing a tray on which a lens sheet is placed.

FIG. 11 is a view showing a tray 1080 on which a lens sheet LS is placed. The tray 1080 on which the lens sheet LS is placed can be fed by the lens sheet feeder unit 1070 of FIG. 6A.

The tray 1080 has an external shape of a rectangle when seen from the vertical direction Z and is provided with a concave portion 1081 having a rectangular shape and depressed than the upper end surface. The lens sheet LS is accommodated in the concave portion 1081. The concave portion 1081 is equipped with a pressing member 1082 for pressing the end section of the lens sheet LS in the main scanning direction X and a pressing member 1083 for pressing the end section of the lens sheet LS in the sub-scanning direction Y. Consequently, the position of the lens sheet LS is fixed with respect to the tray 1080.

Also, as shown in FIG. 7, in a state in which the paper inversion unit 1040 is removed from the mounting section 1020, the upstream side of the recording section 1013 is in an open state. Consequently, the recording device 1000 can also perform recording on the lens sheet LS inserted from the front side of the housing 1005. A user rotates both the operation panel 1006 of FIG. 4 and the front lid portion 1007 to the front surface side and inserts the lens sheet LS in a state in which the front surface side of the recording device 1000 is open.

The recording device 1000 conveys the lens sheet LS to the upstream side using the discharge driving roller 1029, the driven roller 1030, the conveyance driving roller 1026 and the driven roller 1027. Then, while conveying the lens sheet LS to the downstream side, the recording device 1000 performs recording on the lens sheet LS by the recording section 1013. When conveying the lens sheet LS to the upstream side, recording can be performed on the lens sheet LS by the recording section 1013.

The paper P11 and P12 is a first recording medium. The first recording medium is constituted by a flexible member such as a paper material, and the first recording medium does not stop on a curved conveyance route or receive damage by passing through a curved conveyance route.

The lens sheet LS is a second recording medium. The second recording medium is constituted so as to include resin and metal members, etc. Also, the second recording medium includes a material constituted by a thick paper material. The second recording medium is higher in rigidity than the first recording medium.

The paper inversion unit 1040 constitutes a first conveyance device. In the paper inversion unit 1040 of FIG. 4, a curved inversion path curved by the conveyance paths S11, S12 and S14 is provided on the outer peripheral side of the intermediate conveyance driving roller 1050.

The lens sheet feeder unit 1070 constitutes a second conveyance device. The lens sheet feeder unit 1070 of FIG. 7 is provided with a linear conveyance route for linearly conveying along the conveyance surface 1021*a* of the wall section 1021.

The recording device 1000 explained as the aforementioned embodiment includes a housing 1005 as a device main body, a recording section 1013 for performing recording to a paper P11 and P12 and to a lens sheet LS having higher rigidity than the paper P11 and P12 and provided inside the housing 1005, a mounting section 1020 for mounting a conveyance device (paper inversion unit 1040, lens sheet feeder unit 1070), a paper cassette 1012 as a first recording medium storage section for storing the paper P11, and a paper inversion unit 1040 as a first conveyance device having a curved inverting path for inverting the paper P11 fed from the paper cassette 1012 in a curved manner and guiding it to the recording section 1013, in which components of the curved inverting path are unitized and detachably attached to the mounting section 1020. Then, a lens sheet feeder unit 1070 as the second conveyance device capable of linearly conveying the lens sheet LS is mounted to the mounting section 1020, and recording on the lens sheet LS is performed by the recording section 1013.

According to this structure, the recording device 1000 can convey a paper P11 and P12 or a lens sheet LS having higher rigidity than the paper P11 and P12 without being increased in size.

Also, the lens sheet feeder unit 1070 conveys the tray 1080 in which the lens sheet LS of FIG. 11 is placed. Consequently, the positional changes of the lens sheet LS can be controlled by conveying in a state in which the lens sheet LS is placed on the tray 1080.

Also, the lens sheet LS can be conveyed from either the front side or the back side of the device. Consequently, in a direction in which the lens sheet LS is fed from the outside to the inside of the housing 1005, options for a user are increased.

Also, a liquid ejection head 1003 for ejecting an ink as a liquid provided at the recording section 1013 and a supporting member 1028 having a supporting surface for supporting the lens sheet LS or the tray 1080 at a position facing the liquid ejection head 1003 are provided, and at the time of mounting the lens sheet feeder unit 1070, a conveyance surface of the lens sheet feeder unit 1070 (conveyance surface constituted by the sheet guide 71) and the supporting surface of the supporting member 1028 are formed at approximately the same surface.

Consequently, since the lens sheet LS is conveyed without being bent, the lens sheet LS will not be damaged or stopped on the conveyance surface or the supporting surface.

Also, the lens sheet feeder unit 1070 is equipped with a press roller 1073 for pressing the lens sheet LS or the tray 1080.

Consequently, since the engaged state of the lenticular lens LS1 of the lens sheet LS of FIG. 6C and the convex portions 1711 of the sheet guide 1071 can be maintained, the movement of the lens sheet LS with respect to the sheet guide 1071 can be controlled.

Also, the lens sheet feeder unit 1070 is equipped with feeding rollers 1074 as a conveyance drive roller for conveying the lens sheet LS. Consequently, the lens sheet LS can be conveyed to the recording section 1013 side.

Also, the feeding roller 1074 is driven by a driving force for conveying the paper P11 and P12. Consequently, since a driving mechanism for generating a driving force for driving the feeding roller 1074 is not required to be separately provided, the recording device 1000 can be controlled from being increased in size.

Further, the lens sheet feeder unit 1070 is equipped with edge guides 1072*a* and 1072*b* for controlling the positions of the end sections of the lens sheet LS in a direction intersecting with the conveyance direction (main scanning direction X) and guiding the conveyance direction of the lens sheet LS as the guide section. Consequently, the quality of an image formed on the lens sheet LS can be controlled from being deteriorated.

Further, the lens sheet feeder unit 1070 is equipped with the sheet guide 1071 of FIG. 6B and the sheet guide 1071 is equipped with a plurality of convex portions 1711 as engaging sections to be engaged with an irregular portion formed by the lens L of the lens sheet LS in a direction intersecting with the conveyance direction of the lens sheet LS (main scanning direction). According to this structure, the position of the lens sheet LS in the main scanning direction X can be determined.

Further, the paper inversion unit 1040 conveys a paper P11 and P12 in a state in which the recording surface is inverted. Consequently, the recording surface of the paper P11 and P12 can be inverted using the paper inversion unit 1040.

Further, the lens sheet LS has a structure for forming a stereoscopically visible image by parallax variation. Consequently, a stereoscopically visible image by parallax variation can be formed on the lens sheet LS using the recording device 1000.

Also, the paper inversion unit 1040 is provided with a conveyance path having a feeder opening 1008 as the second recording medium storage section at the top section for storing the paper P12 in an inclined state for conveying the paper P12 from the feeder opening 1008 to the recording section 1013.

According to this configuration, for a means to feed the paper P12 to the recording section 1013, it becomes possible to increase the options for a user and also control the recording device 1000 from being increased in size.

The recording device 1000 of FIG. 4 in this embodiment is provided, on the upstream side of the recording section 1013, with a portion in which the conveyance routes of papers P11 and P12 intersect (conveyance path S13), but the present invention can be applied to a recording device provided with a portion where the conveyance routes of the papers intersect is provided at the downstream side of the recording section.

Figure 10:
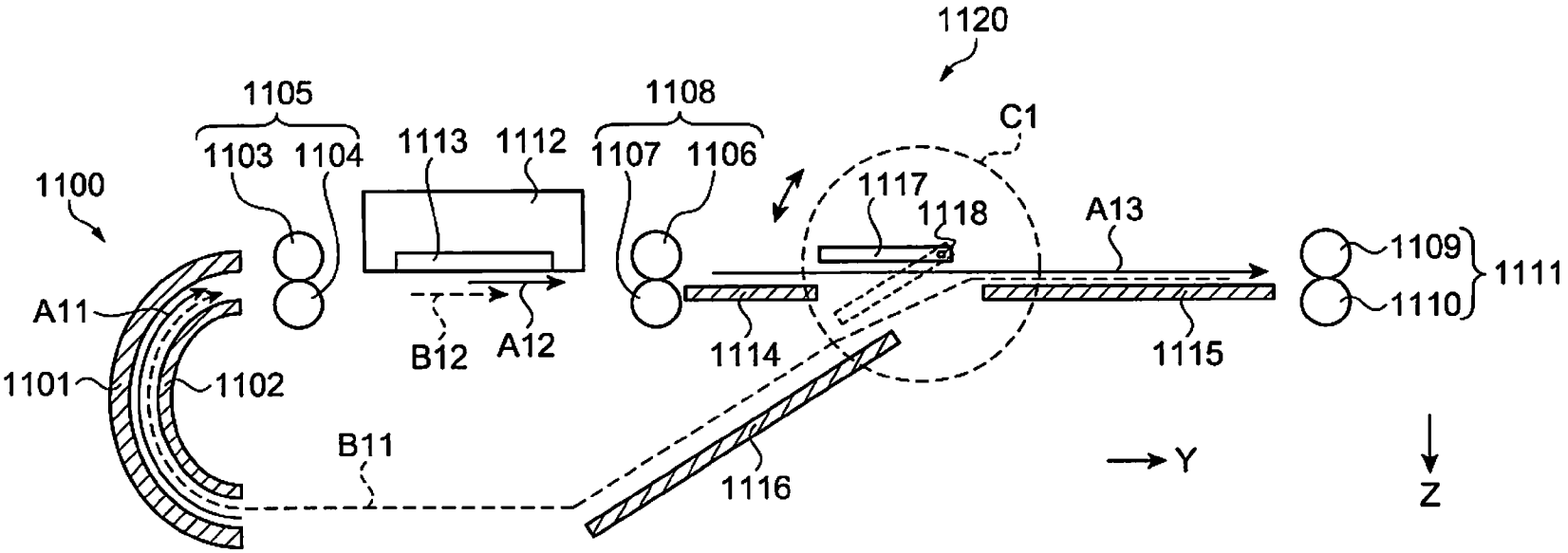
FIG. 10 is a view showing a schematic configuration of the recording device in which a portion where a conveyance route of a paper intersects is provided at a downstream side of a recording section in a sub-scanning direction.

FIG. 10 is a view seen from the main scanning direction, showing a schematic configuration of the recording device 1120 in which a portion where conveyance routes of a paper intersect is provided at a downstream side of a recording section. The recording device 1120 is equipped with a paper inversion section 1100 having a curved route between the inner wall section 1102 and the outer wall section 1101. Also, on the downstream side of the recording section configured to include a liquid ejection head 1113 provided on a carriage 1112 that is reciprocated in the main scanning direction, a portion C1 where the conveyance routes of a paper intersect is provided (within the circle as shown by the broken line). At a portion C1 where the conveyance routes of a paper intersect, a swinging member 1117 which swings about a rotational axis 1118 as a fulcrum is provided.

On the upstream side of the liquid ejection head 1113, a pair of rollers 1105 is provided, in which one of the rollers 1103 and 1104 is a driving roller and the other is a driven roller. On the downstream side of the liquid ejection head 1113, a pair of rollers 1108 is provided, in which one of the rollers 1106 or 1107 is a driving roller and the other is a driven roller, and a pair of rollers 1111 is provided, in which one of the rollers 1109 and 1110 is a driving roller and the other is a driven roller.

As shown by the solid arrows A11 and A12, via the paper inversion section 1100, a paper is conveyed to the downstream side (right side of the drawing) along the member 1114 constituting the conveyance surface by the pair of rollers 1105 and 1108. On a conveyed paper, an image is formed on one of the recording surfaces at a position facing the liquid ejection head 1113.

As shown by the solid arrow A13, since the swinging member 1117 is at a rotating position as shown by a solid line and the conveyance route is in an open state, the paper is conveyed to the downstream side by the pair of rollers 1111 along a member 1115 constituting the conveyance surface.

Also, the paper is conveyed to the upstream side (left side of the drawing) from the reverse rotation of the pair of rollers 1111. At this time, the swinging member 1117 rotates to the position as shown by the broken line, which in turn closes the conveyance route on the member 1114 side and opens the conveyance route on the member 1116 side, and as shown by the broken line arrow B11, the paper is conveyed along a member 1116 constituting the conveyance surface. Then, the paper again goes through the curved route of the paper inversion section 1100 and the position facing the liquid ejection head 1113, and an image is formed on the other recording surface.

Second Embodiment

Figure 12A:
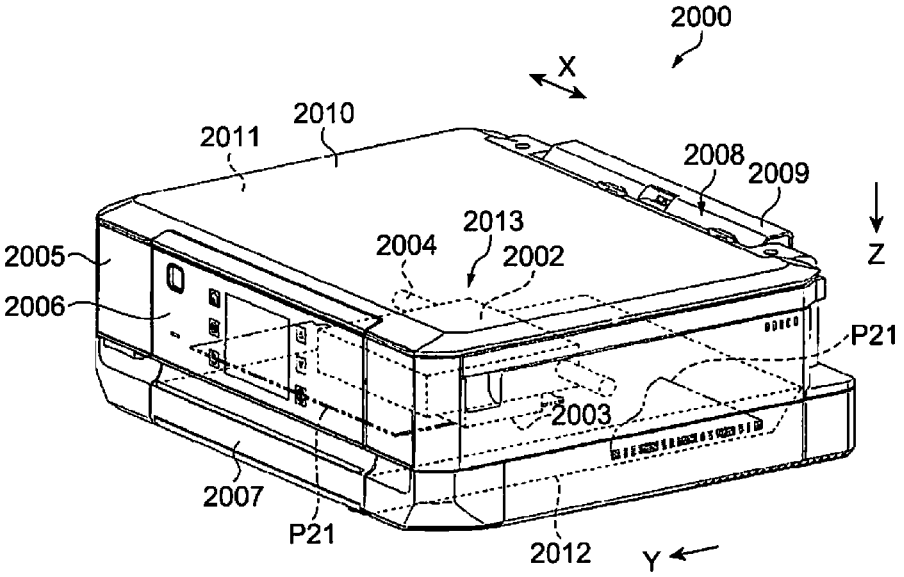
FIGS. 12A and 12B are external perspective views of a recording device according to a second embodiment.
Figure 12B:
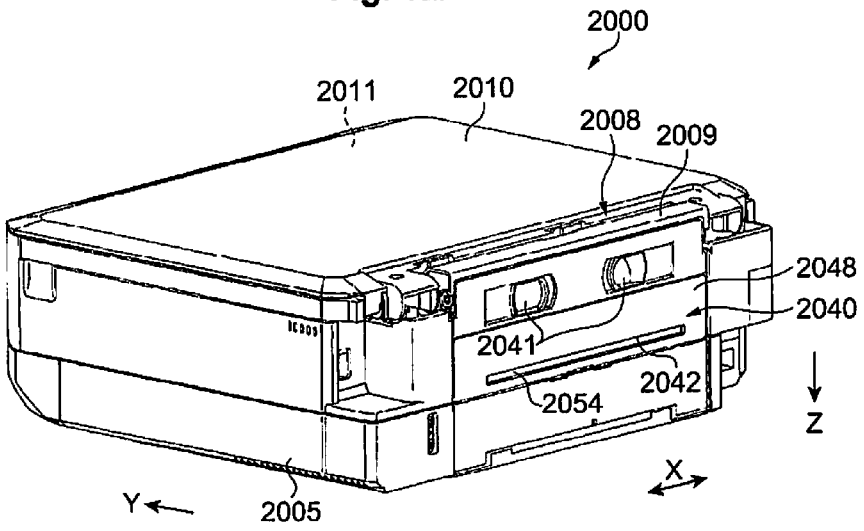

Next, a recording device according to a second embodiment will be explained with reference to the drawings. FIG. 12A is an external perspective view of a recording device 2000 of this embodiment as seen from the front side. FIG. 12B is an external perspective view of the recording device 2000 of this embodiment as seen from the back side. The recording device 2000 is provided, in a housing 2005 having an approximately rectangular parallelepiped shape surrounded by a plurality of frames, with a recording section 2013 configured to record an image by ejecting an ink. The recording section 2013 is equipped with a liquid ejection head 2003 for ejecting an ink and includes a carriage 2002 that is reciprocated in the main scanning direction X along a guide member 2004 in accordance with the drive of a carriage motor (not illustrated).

On the front side of the housing 2005, an operation panel 2006 for operating the recording section 2013 is arranged. On the upper surface side of the operation panel 2006 in the vertical direction Z, an image reading section 2011 is arranged. A user can make the recording device read an image by rotating a cover 2010 provided on the top section of the housing 2005 and placing a manuscript, etc., as an object to be read on the manuscript stand (not illustrated).

The operation panel 2006 is equipped with a display section (e.g., a liquid crystal display) for displaying a menu screen or the like, an operation section (e.g., an operation button). The operation panel 2006 is configured so that the lower side thereof can be lifted forwardly to be opened by the rotation mechanism such as a hinge provided on the upper side and is openably/closably attached to the housing 2005.

Below the recording section 2013, a paper cassette 2012 for placing papers P21 thereon in a stacked state is provided. Below the operation panel 2006, a front lid portion 2007 is rotatably provided with the bottom section secured as a fulcrum, so that the paper cassette 2012 is insertably/removably provided in the housing 2005 in a state in which the front lid portion 2007 is rotated forward and opened. The paper P21 placed on the paper cassette 2012 is fed to the recording section 2013 and recorded, then discharged to the downstream side in the sub-scanning direction Y (hereinafter referred to as "downstream side").

Figure 13A:
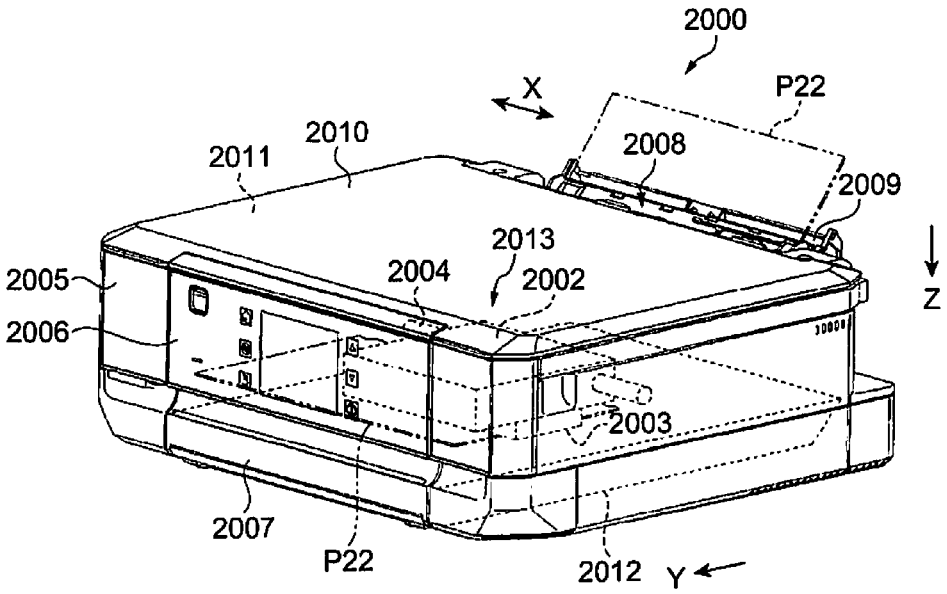
FIGS. 13A and 13B are external perspective views showing a recording device according to the second embodiment.
Figure 13B:
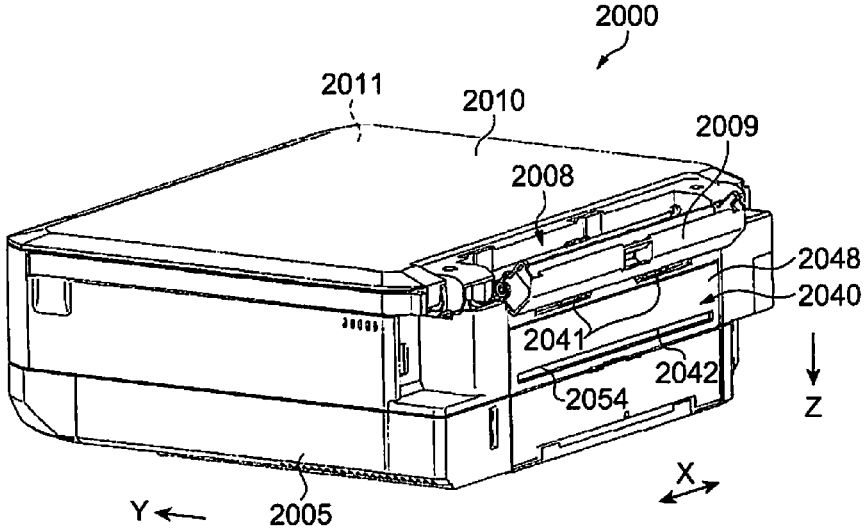

FIGS. 13A and 13B each show a state in which the opening/closing lid 2009 provided at the back side top section of the recording device 2000 is rotated and open. A user rotates the opening/closing lid 2009 and inserts a paper P22 one by one from the feeder opening 2008 by hand. The paper P22 inserted from the feeder opening 2008 is fed to the recording section 2013, recorded, and discharged to the downstream side.

On the back side wall section 2048 on the back side of the paper inversion unit 2040 of FIGS. 12B and 13B, an opening section 2042 extending in the main scanning direction X is provided. The opening section 2042 is an insertion opening for a lens sheet LS (see FIGS. 8A and 8B) also used in the recording device 1000 according to the aforementioned Embodiment 1 to be inserted by a user.

Figure 14:
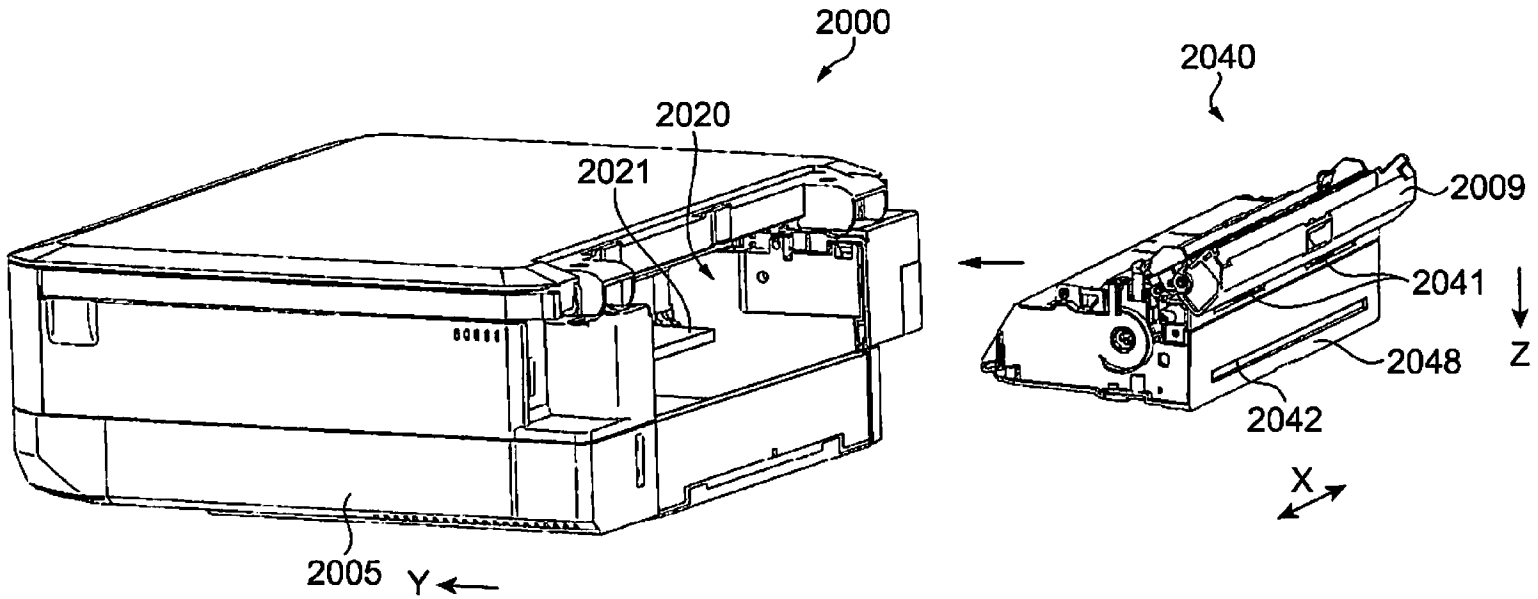
FIG. 14 is an external view of the recording device in a state in which a paper inversion unit is removed.

FIG. 14 is a perspective view of the recording device 2000 as seen from the back side thereof in a state in which the paper inversion unit 2040 is removed backwards from the mounting section 2020 provided in the housing 2005. Above the paper cassette 2012 on the back side of the recording device 2000 of FIG. 12A, the paper inversion unit 2040 of FIG. 13 equipped with a paper inversion mechanism is detachably provided to the mounting section 2020.

The paper inversion unit 2040 includes a conveyance route for conveying the paper P21 placed on the paper cassette 2012 of FIG. 12A toward the recording section 2013 and for conveying the paper P22 inserted from the feeder opening 2008 of FIG. 13A toward the recording section 2013.

Further, the conveyance route of the paper inversion unit 2040 functions as a conveyance route for inverting the front and rear surfaces of a paper P21 and P22, that is, for inverting the recording surfaces to perform recording on both surfaces of the papers P21 and P22 to be fed to the recording section 2013.

The paper inversion unit 2040 of FIG. 12B is provided with a pair of operation sections 2041 which moves slidingly in the main scanning direction X when the user inserts fingertips and performs a gripping operation. When the user slidingly moves the operation sections 2041 so as to approach each other, the locked state to the housing 2005 is released, thereby allowing the paper inversion unit 2040 to be removed backward from the housing 2005.

Figure 15:
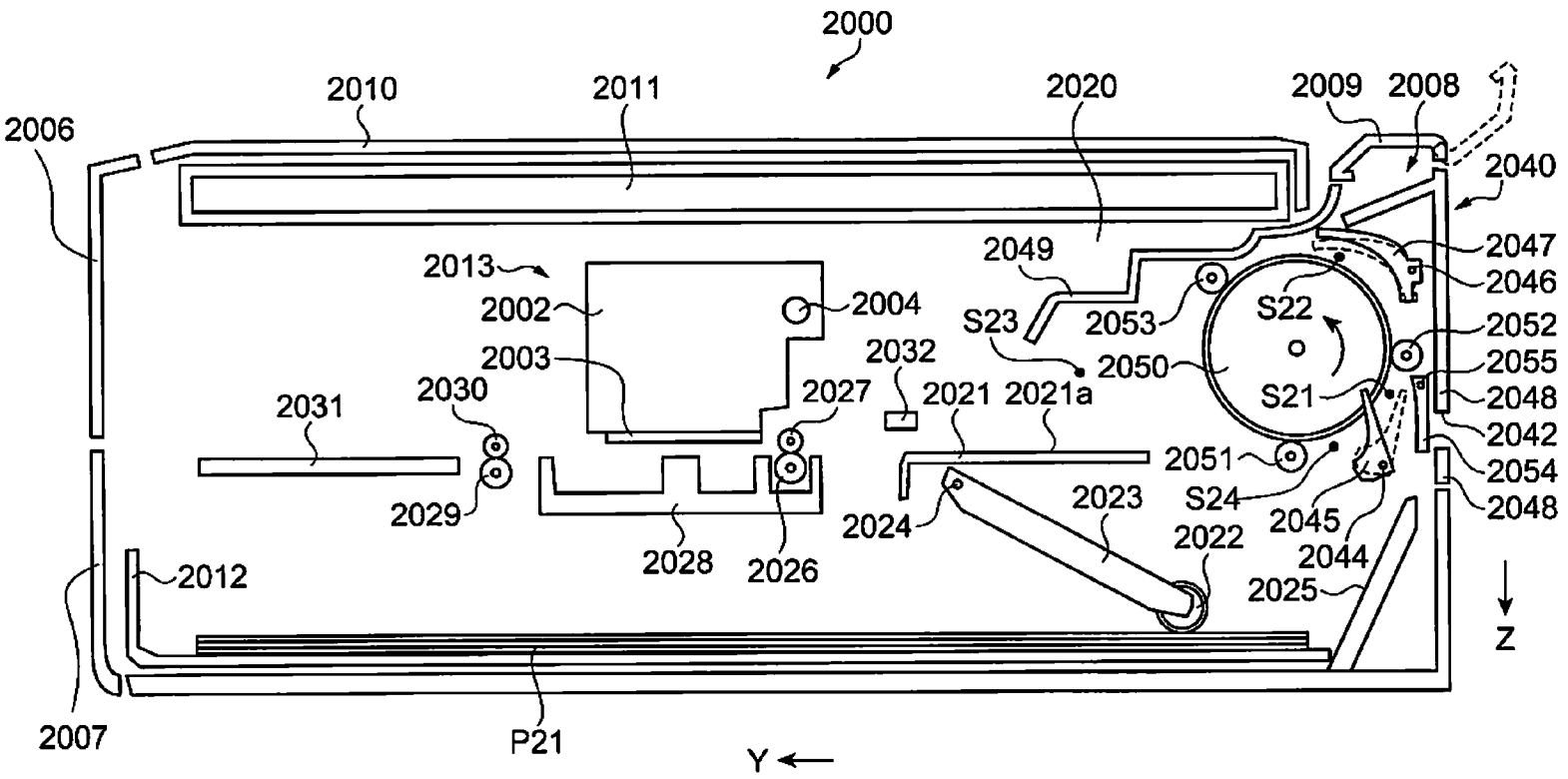
FIG. 15 is a cross-sectional view of a schematic configuration of the recording device.

FIG. 15 is a cross-sectional view of a schematic structure of the recording device 2000 as seen from the main scanning direction X in a state in which the paper inversion unit 2040 is mounted on the mounting section 2020. Above the recording section 2013, an image reading section 2011 equipped with a cover 2010 on the top section thereof is arranged. Below the mounting section 2020, a feeding roller 2022 supported by the swinging member 2023, which swings about a rotational shaft 2024 as a fulcrum, is provided.

The housing of the paper inversion unit 2040 includes a back side wall section 2048 and a top side wall section 2049. The paper inversion unit 2040 includes an intermediate conveyance driving roller 2050, driven rollers 2051, 2052 and 2053 driven by the driving rotation of the intermediate conveyance driving roller 2050, a swinging member 2045 which swings about a rotational shaft 2044 as a fulcrum, a swinging member 2047 which swings about a rotational shaft 2046, and a swinging member 2054 which swings about a rotational shaft 2055 as a fulcrum. Also, the paper inversion unit 2040 includes an opening/closing lid 2009 and a feeder opening 2008.

The paper P21 placed on the paper cassette 2012 is fed to the conveyance path S21, which is a spatial region formed between the swinging member 2054 and the swinging member 2045 at a rotational position shown by a solid line, via a separating slanted surface 2025, by the driving rotation of the feeding roller 2022. The paper P21 pinched by and between the intermediate conveyance driving roller 2050 rotating in the direction of the arrow and the driven rollers 2052 and 2053 is conveyed to a conveyance path S23, which is a spatial region formed between the top side wall section 2049 and a wall section 2021 provided via the conveyance path S22, which is a spatial region between the swinging member 2047 at a rotational position shown by a solid line and the intermediate conveyance driving roller 2050, and then conveyed to the downstream side along a conveyance surface 2021*a* formed on the top section of the wall section 2021.

The paper P21 conveyed along the conveyance surface 2021*a* is pinched by a conveyance driving roller 2026 which is driven and rotated and a driven roller 2027 which is driven by the driving rotation of the conveyance driving roller 2026, and then conveyed to the downstream side in a manner in which a position facing the liquid ejection head 2003 is supported by a supporting member 2028.

The liquid ejection head 2003 which is reciprocated in the main scanning direction X ejects an ink on the conveyed paper P21 to record an image. The paper P21 is pinched by and between a discharge driving roller 2029 and a driven roller 2030 which is driven by the driving rotation of the discharge driving roller 2029, conveyed to the downstream side along the top surface of a conveyance path forming member 2031, and then discharged from the opening section formed when the front lid portion 2007 is rotated.

In a state in which the opening/closing lid 2009 is rotated to the back side as shown by the broken line, when the paper P22 of FIG. 13A is inserted from the feeder opening 2008, the tip end section of the swinging member 2047 rotates downward as shown by the broken line, thereby opening the intermediate conveyance driving roller 2050 side of the feeder opening 2008.

The paper P22 is pinched by and between the intermediate conveyance driving roller 2050 which is driven and the driven roller 2053, and then conveyed to the conveyance path S23. Then, an image is recorded in the recording section 2013 while the paper P22 is conveyed by the conveyance driving roller 2026 and the driven roller 2027 and the paper P22 is discharged from the opening section formed by the rotation of the front lid portion 2007.

Next, the operation in which the papers P21 and P22 are inverted by the paper inversion unit 2040 and recording is performed on both surfaces, the front surface and the back surface, of the papers P21 and P22 will be explained. The paper P21 conveyed from the paper cassette 2012 via the conveyance paths S21 and S22 and the paper P22 inserted from the feeder opening 2008 are conveyed to the downstream side by the intermediate conveyance driving roller 2050 and the driven roller 2053. At this point, the papers P11 and P12 are each conveyed by the conveyance driving roller 2026 and the driven roller 2027 in a state in which the surface faces upward or to the liquid ejection head 2003 side and an image is recorded on the front surface of the paper P21 and P22 in the recording section 2013.

Then, the paper P21 and P22 on which an image was recorded on the surface, is conveyed to the upstream side (hereinafter referred to as "upstream side") in the sub-scanning direction Y by the reversing rotation of the conveyance driving roller 2026, and then conveyed to the conveyance path S24 which is a spatial region between the driven roller 2051 and the swinging member 2045 by the intermediate conveyance driving roller 2050 which is driven in the direction of the arrow and the driven roller 2051.

As shown by the broken line, the tip end section of the swinging member 2045 rotates to the back side and the paper P21 and P22 is conveyed to the conveyance path S21. Then, the paper P21 and P22 is conveyed via the conveyance paths S22 and S23 by the intermediate conveyance driving roller 2050 and the driven rollers 2052 and 2053. At this point, the paper P11 and P22 is conveyed to the downstream side along the conveyance surface 2021*a* in a state in which the back surface faces upward, conveyed by the conveyance driving roller 2026 and the driven roller 2027, and an image is recorded on the back surface of the paper P21 and P22 in the recording section 2013.

On the upstream side of the liquid ejection head 2003, for example, an optical type end portion detecting section 2032 for detecting an end portion of the paper P21 and P22 in the sub-scanning direction Y is provided.

Figure 16A:
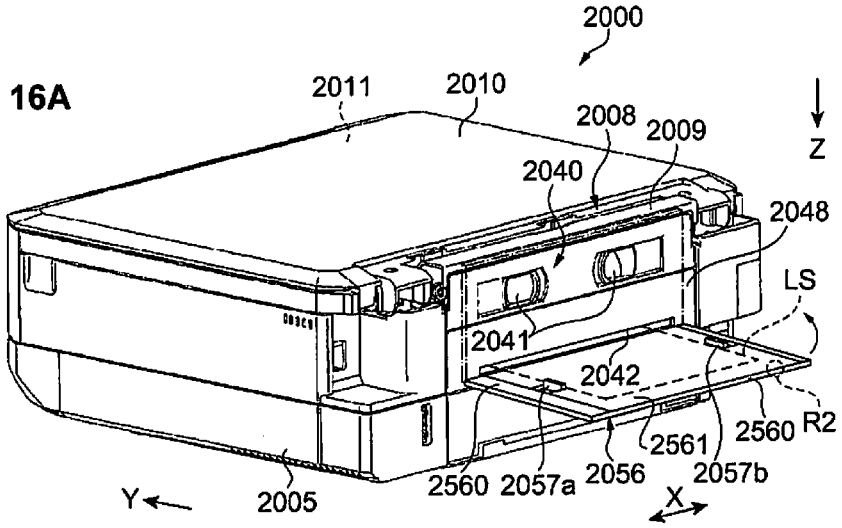
FIG. 16A is an external perspective view showing a recording device equipped with a mounting stand.

FIG. 16A is an external perspective view showing a recording device 2000 equipped with a mounting stand 2056 on the back side of a housing 2005. On the back side of the recording device 2000, a mounting stand 2056 is detachably provided. On the back side of the recording device 2000, an engaging section (not illustrated) for rotatably supporting a mounting stand 2056 is provided. As shown in FIG. 16A, the mounting stand 2056 is provided so that the mounting surface extends in the horizontal direction. A user mounts a lens sheet LS to the mounting stand 2056 and inserts the lens sheet LS from the opening section 2042.

Also, since the lens sheet LS has the same structure as the lens sheet LS (see FIG. 8) used in the recording device 1000 according to the aforementioned first embodiment, the explanation will be omitted.

A user can rotate the tip end section (right side of the drawing) of the mounting stand 2056 in the direction of the arrow to thereby bring the mounting surface of the mounting stand 2056 in a vertical state as shown by a dashed line. According to this configuration, when it is not required to perform recording by inserting a lens sheet LS from the opening section 2042, the mounting stand 2056 can be brought into a vertical state to thereby reduce the occupied spatial region on the back side of the recording device 2000.

On both sides of the top section of the mounting stand 2056 in the main scanning direction X, edge guides 2057*a* and 2057*b* for controlling the positions of both end sections of the lens sheet LS in the main scanning direction X are slidably provided in the main scanning direction X. Edge guides 2057*a* and 2057*b* are upwardly standing on the mounting stand 2056 and shaped so as to extend in the sub-scanning direction Y.

Figure 16B:
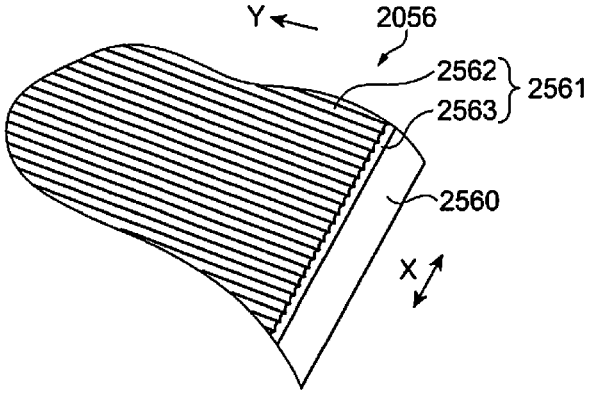
FIG. 16B is a view showing a portion of the mounting stand.

On the top section of the mounting stand 2056, a sheet guide 2561 of FIG. 16B is provided. The sheet guide 2561 is provided within the maximum range in which both end sections of the lens sheet LS are controlled in the main scanning direction X by the edge guides 2057*a* and 2057*b*. Also, the sheet guide 2561 is provided on the top section of the mounting stand 2056 in the sub-scanning direction Y from an end section on the front side to the end section on the back side of the mounting stand 2056 with the exception of the range in which the edge guides 2057*a* and 2057*b* are provided.

FIG. 16B is an enlarged view of a portion of the mounting stand 2056 within the circle as shown by the broken line R2. The mounting stand 2056 is constituted by a supporting member 2560 and a sheet guide 2561 adhered to the top section of the supporting member 2560.

Figure 16C:
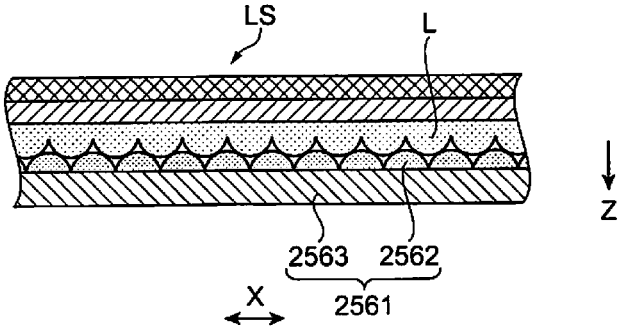
FIG. 16C is a cross-sectional view of a sheet guide and a lens sheet.

FIG. 16C is a cross-sectional view of the sheet guide 2561 and the lens sheet LS placed on the top section of the sheet guide 2561 as seen from the sub-scanning direction Y. The sheet guide 2561 is constituted by adhering the convex portions 2562 made of the same material as the lenticular lens LS1 on the substrate 2563.

The convex portion 2562 is formed into the same shape as the lenticular lens LS1 of the lens sheet LS and formed with the same pitch as the arranged pitch K of the lenticular lens LS1 as shown in FIG. 8B.

In addition, the interval of the convex portions 2562 in the X direction is not always required to be the same lens pitch K of the lenticular lens LS1 and can be the interval of the integer multiple of the lens pitch K.

Also, when forming the substrate 2563 by resin molding, a mold surface corresponding to the convex portions 2562 can be formed on a molding die in advance and the convex portions 2562 and the substrate 2563 can be formed integrally. Also, by forming the substrate 2563 with resin material having low friction such as a fluororesin, etc., the friction between the lens sheet LS and the convex portion 2562, the friction between the lens sheet LS and the convex portion 1711 can be reduced, thereby allowing a smooth conveyance of the lens sheet LS. Also, the substrate 2563 can be formed with a metal board. In that case, the convex portions 2562 can be formed by subjecting the metal board to a cutting process.

Figure 17:
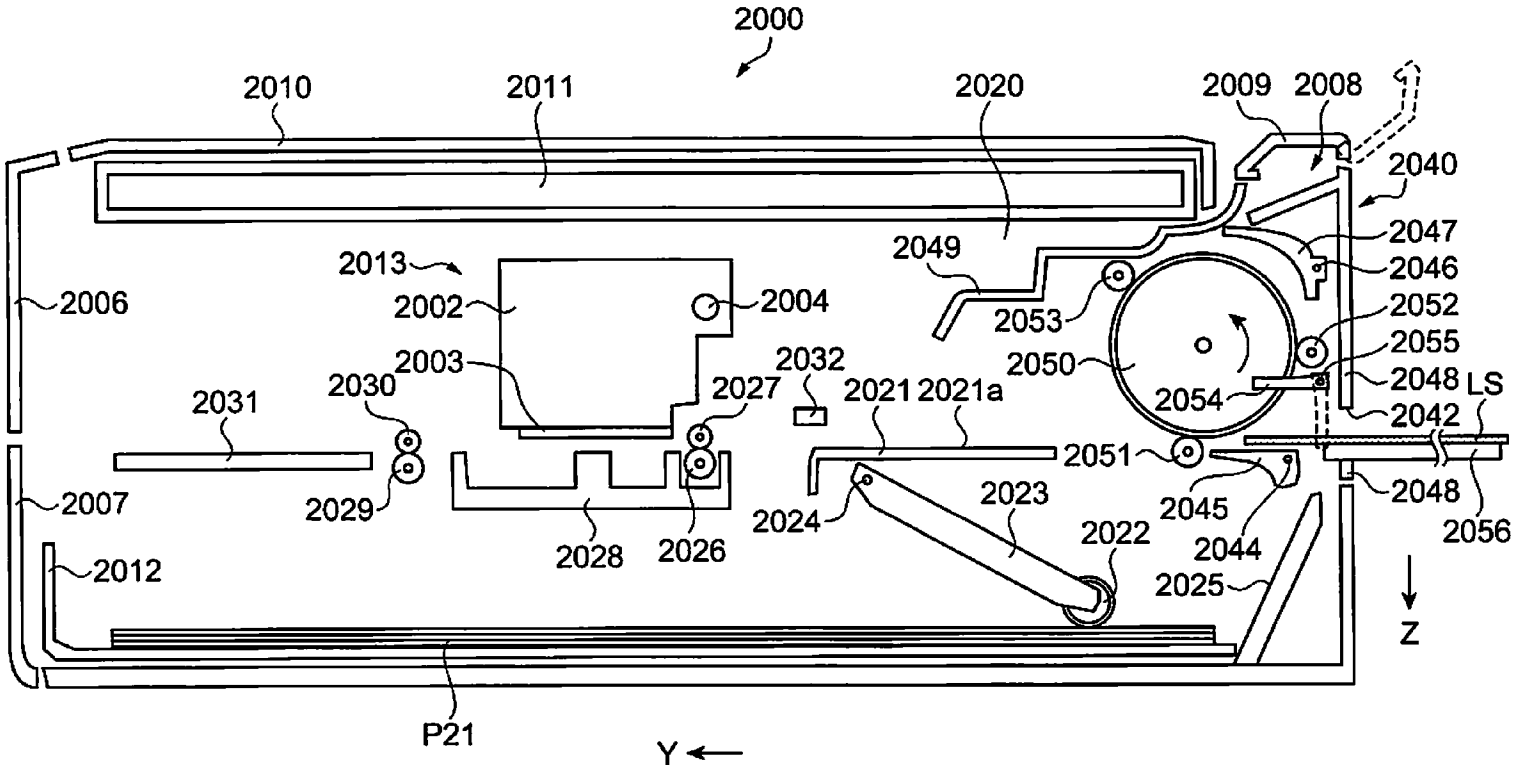
FIG. 17 is a cross-sectional view showing a state in which a lens sheet is inserted from an opening section of a paper inversion unit.

FIG. 17 a cross-sectional view showing a state in which a lens sheet LS is inserted from an opening section 2042 of a paper inversion unit 2040. When recording an image on a paper P21 and P22, the swinging member 2054 is in a rotating position as shown by a broken line, and as shown in FIGS. 12B and 13B, the opening section 2042 is in a state in which it is covered from the inside.

When forming an image on a lens sheet LS, with operation buttons on an operation panel 2006, a user sets the swinging member 2054 and the swinging member 2045 to rotation positions as shown in FIG. 16 (the swinging member 2054 is set to a rotational position as shown by a solid line). Consequently, the opening section 2042 will be in an open state, which in turn opens the space between the swinging member 2045 and the swinging member 2054 and the space between the swinging member 2045 and the intermediate conveyance driving roller 2050.

Then, the lens sheet LS inserted from the opening section 2042 is pinched by the intermediate conveyance driving roller 2050 and the driven roller 2051 and conveyed to the downstream side along the conveyance surface 2021*a* formed on the top section of the wall section 2021.

The end section on the downstream side and the upstream side of the conveyed lens sheet LS is detected by the end portion detecting section 2032. Furthermore, the lens sheet LS is conveyed to a position on the top section of a supporting member 2028 in which the liquid ejection head 2003 faces, an image is recorded by the recording section 2013, and the lens sheet LS is discharged from the opening section formed by the rotation of the front lid portion 2007 to the front surface side.

Figure 19:
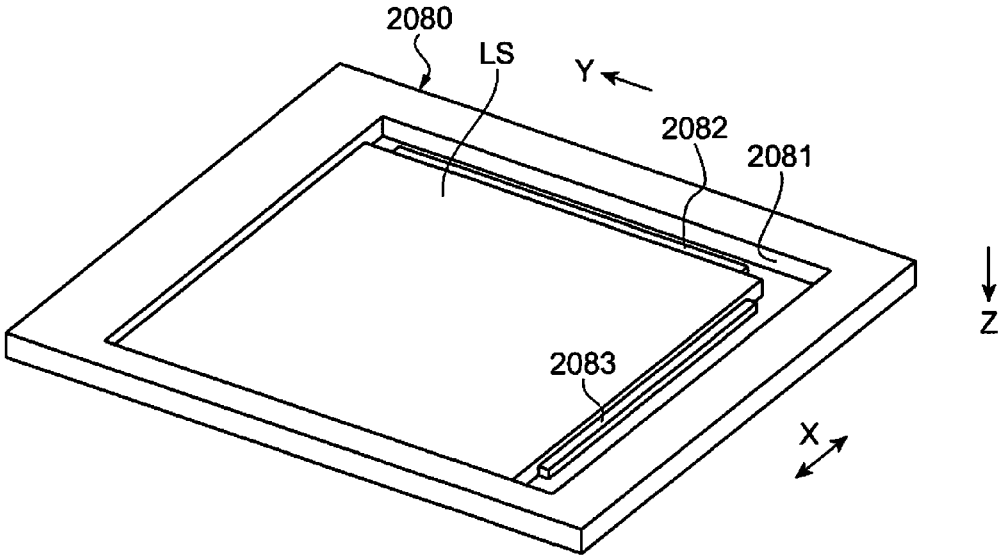
FIG. 19 is a perspective view showing a tray on which a lens sheet is placed.

FIG. 19 is a view showing a tray 2080 on which a lens sheet LS is placed. It can be configured such that the tray 2080 on which a lens sheet LS is placed is inserted along the mounting stand 2056 of FIG. 17 and the tray 2080 is conveyed to the recording section 2013 side by the intermediate conveyance driving roller 2050 and the driven roller 2051 to form an image on the lens sheet LS.

The tray 2080 has an external shape of a rectangle when seen from the vertical direction Z and is provided with a concave portion 2081 having a rectangular shape and depressed than the upper end surface. The lens sheet LS is accommodated in the concave portion 2081. The concave portion 2081 is equipped with a pressing member 2082 for pressing the end section of the lens sheet LS in the main scanning direction X and a pressing member 2083 for pressing the end section of the lens sheet LS in the sub-scanning direction Y. Consequently, the position of the lens sheet LS is fixed with respect to the tray 2080.

As shown in FIG. 14, in a state in which the paper inversion unit 2040 is removed from the mounting section 2020, the upstream side of the recording section 2013 is in an open state. Consequently, the recording device 2000 can perform recording also on the lens sheet LS inserted from the front side of the housing 2005. A user rotates both the operation panel 2006 of FIG. 12A and the front lid portion 2007 toward the front surface side and insert the lens sheet LS in a state in which the front surface side of the recording device 2000 is open.

The recording device 2000 conveys the lens sheet LS to the upstream side using the discharge driving roller 2029, the driven roller 2030, the conveyance driving roller 2026 and the driven roller 2027 of FIG. 17. Then, while conveying the lens sheet LS to the downstream side, recording is performed on the lens sheet LS by the recording section 2013. When conveying the lens sheet LS to the upstream side, it can be configured such that recording is performed on the lens sheet LS by the recording section 2013.

The paper P21 and P22 is a first recording medium. The first recording medium is constituted by a flexible member such as a paper material and the first recording medium does not stop on a curved conveyance route or receive damage by passing through a curved conveyance route.

The lens sheet LS is a second recording medium. The second recording medium is constituted so as to include resin and metal members, etc. Also, the second recording medium includes a material constituted by a thick paper material.

The paper inversion unit 2040 constitutes a curved route conveyance portion. In the paper inversion unit 2040 of FIG. 15, a curved inversion path curved by the conveyance paths S21, S22 and S24 is provided on the outer peripheral side of the intermediate conveyance driving roller 2050.

The recording device 2000 explained as the aforementioned embodiment includes a recording section 2013 for performing recording on papers P21 and P22 as the first recording medium and a lens sheet LS as the second recording medium, a paper cassette 2012 as a recording medium storage section for storing the paper P21, and a paper inversion unit 2040 as a curved route conveyance portion having a curved route for conveying the paper P21 fed from the paper cassette 2012 side to the recording section 2013 side.

Further, the paper inversion unit 2040 is provided with an opening section 2042 capable of inserting a lens sheet LS, and the opening section 2042 is provided at a position of the lens sheet LS when recording is performed by the recording section 2013 in the vertical direction Z, and between the opening section 2042 and the position of the lens sheet LS at the time of recording, a linear conveyance route for linearly conveying the lens sheet is provided.

According to this structure, the lens sheet is conveyed on the linear conveyance route to be recorded by the recording section 2013 without being conveyed on the curved route. Therefore, the lens sheet LS will not stop or be damaged on the curved route. Therefore, since the recording device 2000 can be configured as a common recording device 2000 for performing recording on a paper P21 and P22, and a lens sheet LS and not as a recording device dedicated for performing recording on a lens sheet LS, an increase in manufacturing cost of the recording device 2000 can be restrained.

Also, on the lower side of the opening section 2042, a mounting stand 2056 extending in the horizontal direction and for mounting a lens sheet LS is provided. Consequently, the lens sheet LS can be conveyed to the recording section 2013 side in a stable state.

The extending direction of the mounting stand 2056 can be changed to a vertical direction. According to this structure, the spatial region occupied by the back side of the recording device 2000 can be reduced when the mounting stand 2056 is not used.

Further, the mounting stand 2056 of FIG. 16A is equipped with the sheet guide 2561 having a plurality of convex portions 2562 of FIG. 16B and the plurality of convex portions 2562 constitute engaging sections to be engaged with an irregular portion formed by a plurality of lenses L of the lens sheet LS in a direction (main scanning direction X) intersecting with the conveyance direction of the lens sheet LS (sub-scanning direction Y).

According to this structure, the position of the lens sheet LS can be determined in a direction intersecting with the conveyance direction of the lens sheet LS.

Also, the curvature of the lens sheet LS when conveyed on the linear conveyance route formed from the opening section 2042 to the position of the top section of the supporting member 2028 in which the liquid ejection head 2003 faces is less than the curvature of the papers P21 and P22 when conveyed on the paper inversion unit 2040. According to this structure, the lens sheet LS can be prevented from being damaged.

Further, the mounting stand 2056 is equipped with edge guides 2057*a* and 2057*b* for controlling the positions of the end sections of the lens sheet LS in a direction intersecting with the conveyance direction (main scanning direction X) and guiding the conveyance direction of the lens sheet LS as the guide section. When the lens sheet LS is conveyed and recorded in a state in which the lens sheet LS is tilted with respect to the conveyance direction, an ink cannot be ejected to a position corresponding to a parallax variation for each lens L. Therefore, an image formed on the lens sheet LS cannot be viewed stereoscopically.

Since edge guides 2057*a* and 2057*b* control the lens sheet LS from tilting with respect to the conveyance direction, it becomes possible to stereoscopically view the image formed on the lens sheet LS and the quality of an image formed on the lens sheet LS can be controlled from being deteriorated.

Further, the lens sheet LS is placed and conveyed on the tray 2080. Consequently, the positional change of the lens sheet LS can be controlled.

Further, an end portion detecting section 2032 for detecting end portions of papers P21 and P22 and a lens sheet LS in the conveyance direction is provided, and the end sections of the tray 2080 on the downstream side and upstream side thereof in the conveyance direction are detected by the end portion detecting section 2032.

With this, since an end portion detecting section for detecting an end portion of the tray 2080 in the conveyance direction is not required to be separately provided, an increase in the manufacturing cost can be restrained.

Further, the paper inversion unit 2040 conveys a paper P21 and P22 in a state in which the recording surface is inverted. Consequently, the recording surface of the paper P21 and P22 can be inverted using the paper inversion unit 2040.

Further, the lens sheet LS explained in FIG. 8 has a structure for forming a stereoscopically visible image by parallax variation. According to this structure, a stereoscopically visible image by parallax variation can be formed on the lens sheet LS using the recording device 2000.

The recording device 2000 of FIG. 14 in this embodiment is provided, on the upstream side of the recording section 2013, with a portion in which the conveyance routes of papers P21 and P22 intersect (conveyance path S23), but the present invention can be applied to a recording device provided with a portion where the conveyance route of the papers intersect is provided at the downstream side of the recording section.

Figure 18:
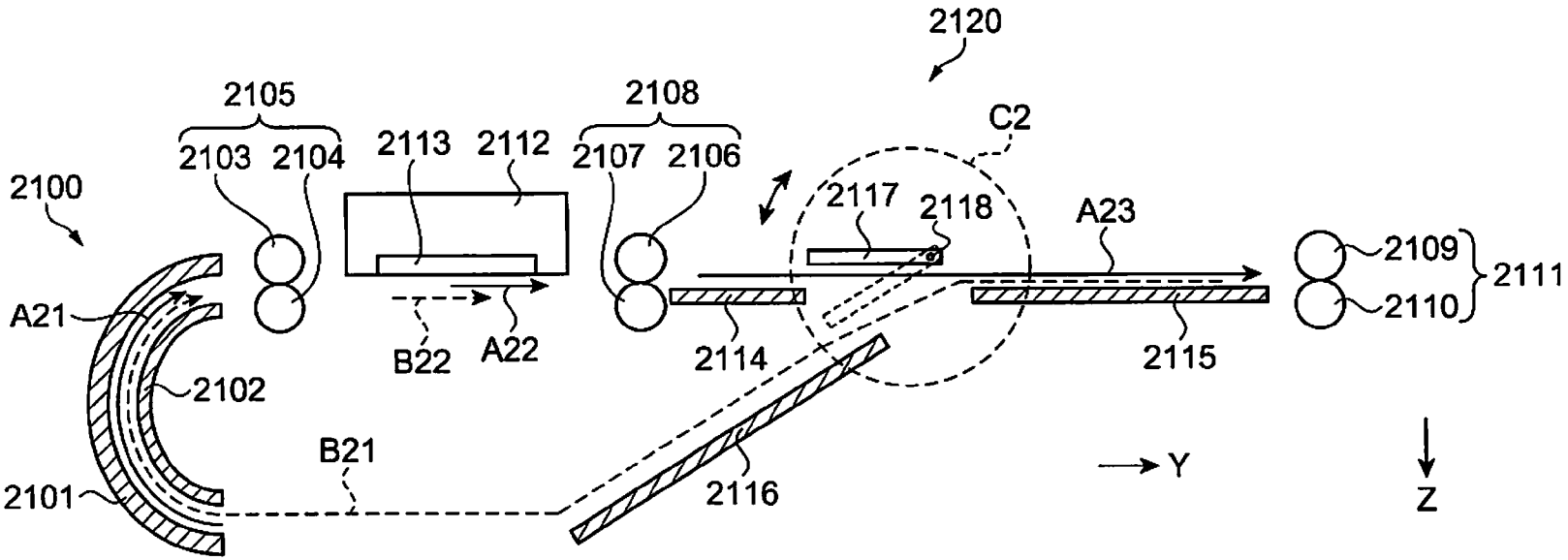
FIG. 18 is a view showing a schematic configuration of the recording device in which a portion where a conveyance route of a paper intersects is provided at a downstream side of a recording section in a sub-scanning direction.

FIG. 18 is a view seen from the main scanning direction, showing a schematic configuration of the recording device 2120 in which a portion where conveyance routes of papers intersect is provided at a downstream side of a recording section. The recording device 2120 is equipped with a paper inversion section 2100 having a curved route between the inner wall section 2102 and the outer wall section 2101. Also, on the downstream side of the recording section configured to include a liquid ejection head 2113 provided on a carriage 2112 that is reciprocated in the main scanning direction, a portion C2 where the conveyance routes of papers intersect is provided (within the circle as shown by the broken line). At a portion C2 where the conveyance routes of papers intersect, a swinging member 2117 which swings about a rotational axis 2118 as a fulcrum is provided.

On the upstream side of the liquid ejection head 2113, a pair of rollers 2105 is provided, in which one of the rollers 2103 and 2104 is a driving roller and the other is a driven roller. On the downstream side of the liquid ejection head 2113, a pair of rollers 2108 is provided, in which one of the rollers 2106 or 2107 is a driving roller and the other is a driven roller, and a pair of rollers 2111 is provided, in which one of the rollers 2109 and 2110 is a driving roller and the other is a driven roller.

As shown by the solid arrows A21 and A22, via the paper inversion section 2100, a paper is conveyed to the downstream side (right side of the drawing) along the member 2114 constituting the conveyance surface by the pair of rollers 2105 and 2108. On a conveyed paper, an image is formed on one of the recording surfaces at a position facing the liquid ejection head 2113.

As shown by the solid arrow A23, since the swinging member 2117 is at a rotating position as shown by a solid line and the conveyance route is in an open state, the paper is conveyed to the downstream side along a member 2115 constituting the conveyance surface by a pair of rollers 2111.

Also, the paper is conveyed to the upstream side (left side of the drawing) from the reverse rotation of the pair of rollers 2111. At this time, the swinging member 2117 rotates to the position as shown by the broken line, which in turn closes the conveyance route on the member 2114 side and opens the conveyance route on the member 2116 side, and as shown by the broken line arrow B21, the paper is conveyed along a member 2116 constituting the conveyance surface. Then, the paper again goes through the curved route of the paper inversion section 2100 and the position facing the liquid ejection head 2113, and an image is formed on the other recording surface.

Third Embodiment

Figure 20A:
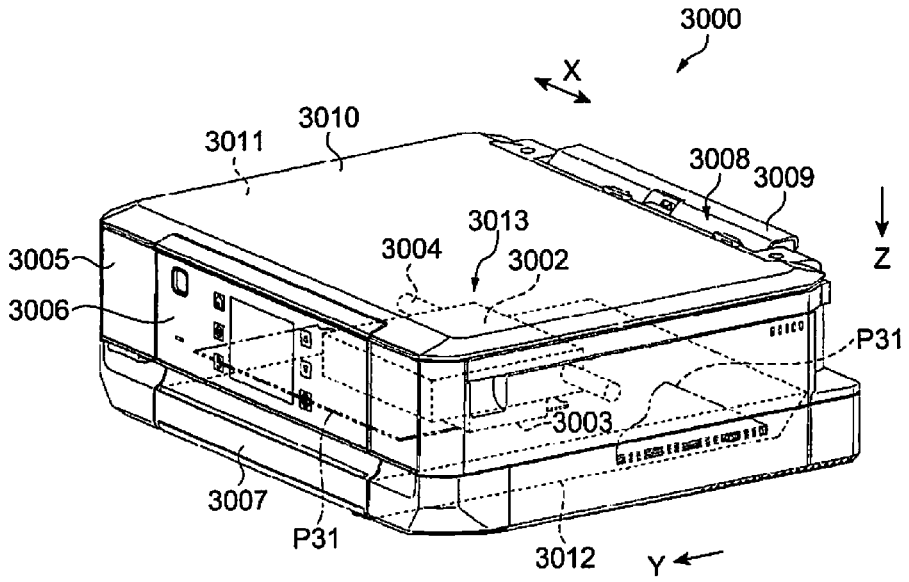
FIGS. 20A and 20B are external perspective views of a recording device according to a third embodiment.
Figure 20B:
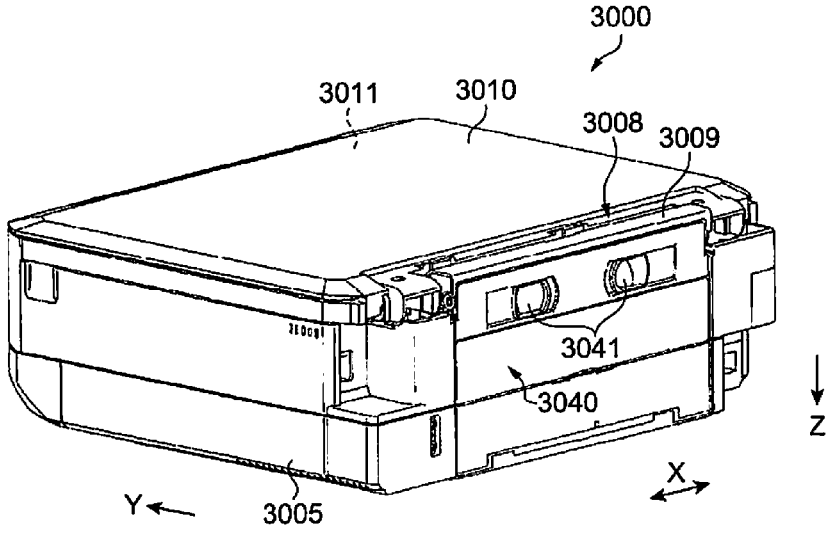

Next, the recording device according to a third embodiment will be explained with reference to the drawings. FIG. 20A is an external perspective view of a recording device 3000 of this embodiment as seen from the front side. FIG. 20B is an external perspective view of the recording device 3000 of this embodiment as seen from the back side. The recording device 3000 is provided, in a housing 3005 having an approximately rectangular parallelepiped shape surrounded by a plurality of frames, with a recording section 3013 configured to record an image by ejecting an ink. The recording section 3013 is equipped with a liquid ejection head 3003 for ejecting an ink and includes a carriage 3002 that is reciprocated in the main scanning direction X along a guide member 3004 in accordance with the drive of a carriage motor (not illustrated).

On the front side of the housing 3005, an operation panel 3006 for operating the recording section 3013 is arranged. On the upper surface side of the operation panel 3006 in the vertical direction Z, an image reading section 3011 is arranged. A user can make the recording device read an image by rotating a cover 3010 provided on the top section of the housing 3005 and placing a manuscript, etc., as an object to be read on the manuscript stand (not illustrated).

The operation panel 3006 is equipped with a display section (e.g., a liquid crystal display) for displaying a menu screen or the like, an operation section (e.g., an operation button). The operation panel 3006 is configured so that the lower side thereof can be lifted forwardly to be opened by the rotation mechanism such as a hinge provided on the upper side and is openably/closably attached to the housing 3005.

Below the recording section 3013, a paper cassette 3012 for placing papers P31 thereon in a stacked state is provided. Below the operation panel 3006, a front lid portion 3007 is rotatably provided with the bottom section secured as a fulcrum, so that the paper cassette 3012 is insertably/removably provided in the housing 3005 in a state in which the front lid portion 3007 is rotated forward and opened. The paper P31 placed on the paper cassette 3012 is fed to the recording section 3013 and recorded, then discharged to the downstream side in the sub-scanning direction Y (hereinafter referred to as "downstream side").

Figure 21A:
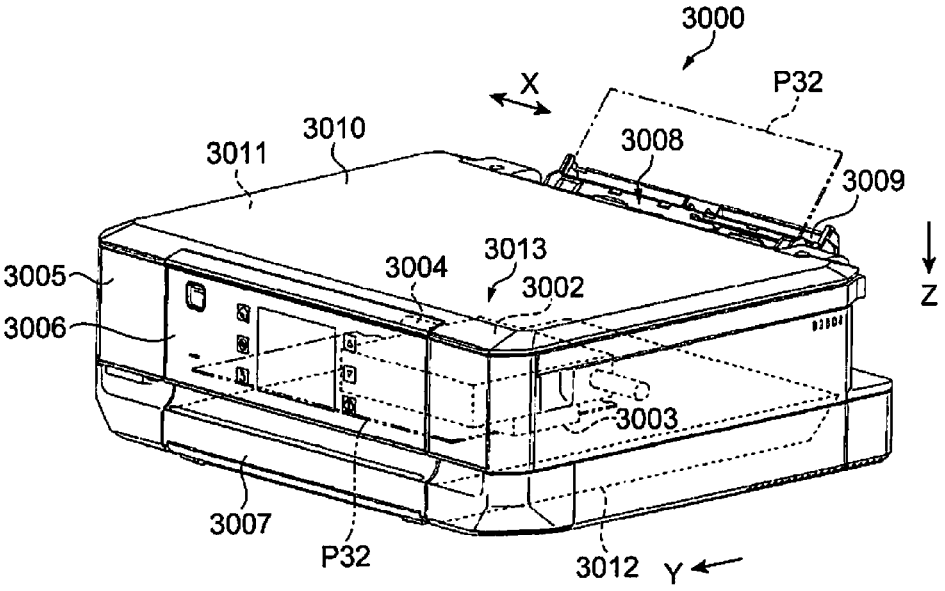
FIGS. 21A and 21B are external perspective view showing the recording device according to the third embodiment.
Figure 21B:
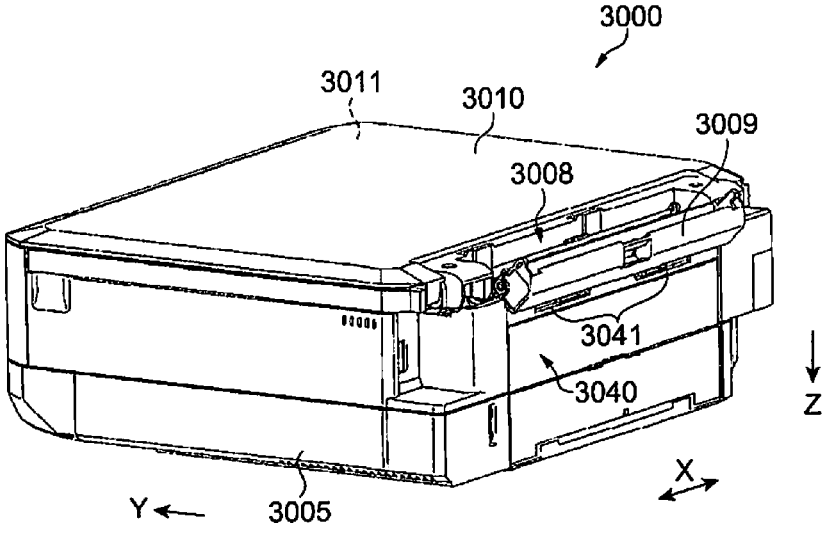

FIGS. 21A and 21B each show a state in which the opening/closing lid 3009 provided at the back side top section of the recording device 3000 is rotated and open. A user rotates the opening/closing lid 3009 and inserts a paper P32 one by one from the feeder opening 3008 by hand. The paper P32 inserted from the feeder opening 3008 is fed to the recording section 3013, recorded, and discharged to the downstream side.

Figure 22:
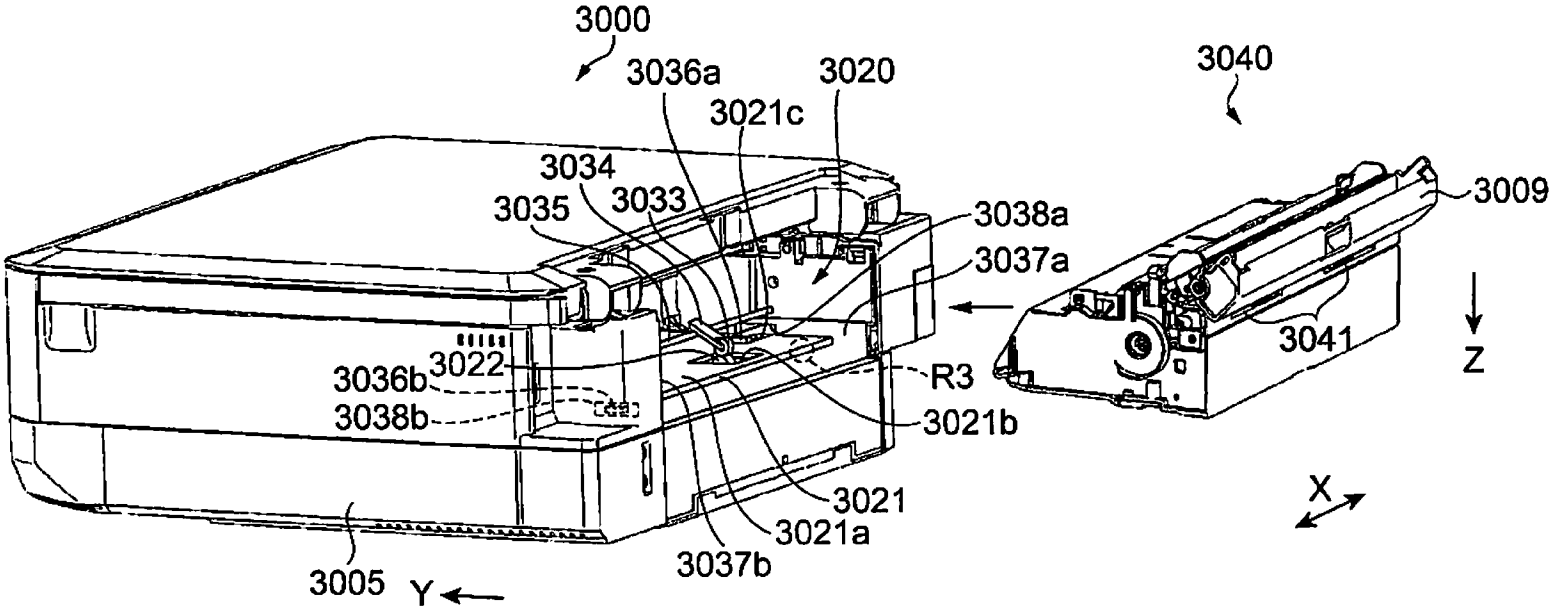
FIG. 22 is perspective view showing a recording device in a state in which a paper inversion unit is removed.

FIG. 22 is a perspective view of the recording device 3000 as seen from the back side thereof in a state in which the paper inversion unit 3040 is removed backwards from the mounting section 3020 provided in the housing 3005. Above the paper cassette 3012 on the back side of the recording device 3000 of FIG. 20A, the paper inversion unit 3040 of FIG. 22 equipped with a paper inversion mechanism is detachably provided to the mounting section 3020.

The paper inversion unit 3040 includes a conveyance route for conveying the paper P31 placed on the paper cassette 3012 of FIG. 20A toward the recording section 3013 and for conveying the paper P32 inserted from the feeder opening 3008 of FIG. 21A toward the recording section 3013.

Further, the conveyance route of the paper inversion unit 3040 functions as a conveyance route for inverting the front and rear surfaces of a paper P31 and P32, that is, for inverting the recording surfaces to perform recording on both surfaces of the papers P31 and P32 to be fed to the recording section 3013.

The paper inversion unit 3040 is provided with a pair of operation sections 3041 which moves slidingly in the main scanning direction X when the user inserts fingertips and performs a gripping operation. The user slidingly moves the operation sections 3041 so as to approach each other, the locked state to the housing 3005 is released, thereby allowing the paper inversion unit 3040 to be removed backward from the housing 3005.

Figure 23:
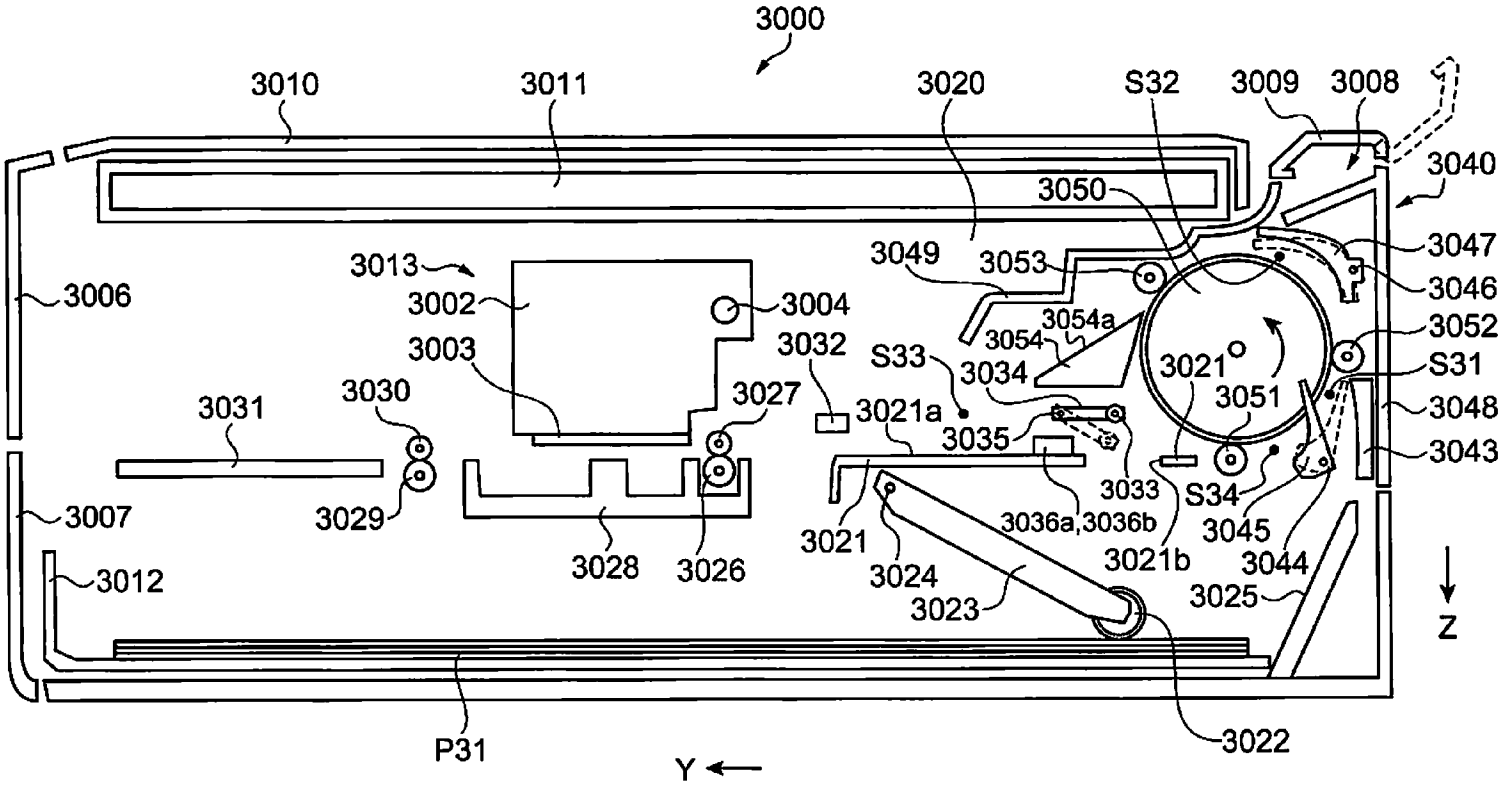
FIG. 23 is a cross-sectional view showing a schematic configuration of the recording device in a state in which a paper inversion unit is mounted thereon.

FIG. 23 is a cross-sectional view of a schematic structure of the recording device 3000 as seen from the main scanning direction X in a state in which the paper inversion unit 3040 is mounted on the mounting section 3020. Above the recording section 3013, an image reading section 3011 equipped with a cover 3010 on the top section thereof is arranged. Below the mounting section 3020, a feeding roller 3022 supported by the swinging member 3023, which swings about a rotational shaft 3024 as a fulcrum, is provided.

The housing of the paper inversion unit 3040 includes a back wall section 3048 and an upper section wall section 3049. The paper inversion unit 3040 includes an intermediate conveyance driving roller 3050, driven rollers 3051, 3052 and 3053 driven by the driving rotation of the intermediate conveyance driving roller 3050, a swinging member 3045 which swings about a rotational axis 3044 as a fulcrum, and a swinging member 3047 which swings about a rotational axis 3046 as a fulcrum. Also, the paper inversion unit 3040 includes a partition member 3054 for partitioning between an upper section wall section 3049 and a wall section 3021, a wall member 3043 provided between the back wall section 3048 and the swinging member 3045, the opening/closing lid 3009, and members constituting the feeder opening 3008.

The paper P31 placed on the paper cassette 3012 is fed to the conveyance path S31, which is a spatial region formed between the wall member 3043 and the swinging member 3045 at a rotational position shown by a solid line, via a separating slanted surface 3025 by the driving rotation of the feeding roller 3022. The paper P31 pinched by and between the intermediate conveyance driving roller 3050 rotating in the direction of the arrow and the driven rollers 3052 and 3053 is conveyed via the conveyance path S32, which is a spatial region between the swinging member 3047 at a rotational position shown by a solid line and the intermediate conveyance driving roller 3050, and then conveyed along a conveyance surface 3054*a* of the partition member 3054. Then, the paper P31 is conveyed to the conveyance path S33, which is a spatial region formed between the upper section wall section 3049 and the wall section 3021, and further conveyed along the conveyance surface 3021*a* formed at the top section of the wall section 3021.

The paper P31 conveyed along the conveyance surface 3021*a* is pinched by a conveyance driving roller 3026 which is driven and rotated and a driven roller 3027 which is driven by the driving rotation of the conveyance driving roller 3026, and then conveyed to the downstream side in a manner in which a position facing the liquid ejection head 3003 is supported by a supporting member 3028.

The liquid ejection head 3003 which is reciprocated in the main scanning direction X ejects an ink on the conveyed paper P31 to record an image. The paper P31 is pinched by and between a discharge driving roller 3029 and a driven roller 3030 which is driven by the driving rotation of the discharge driving roller 3029, conveyed to the downstream side along the top surface of a conveyance path forming member 3031, and then discharged from the opening section formed through the front lid portion 3007 opened by being rotated.

In a state in which the opening/closing lid 3009 is rotated to the back side as shown by the broken line, when the paper P32 of FIG. 21A is inserted from the feeder opening 3008, the tip end section of the swinging member 3047 rotates downward as shown by the broken line, thereby opening the intermediate conveyance driving roller 3050 side of the feeder opening 3008.

The paper P32 is pinched by and between the intermediate conveyance driving roller 3050 which is driven and the driven roller 3053, and then conveyed to the conveyance path S33 along the conveyance surface 3054*a* of the partition member 3054. Then, an image is recorded in the recording section 3013 while the paper P32 is conveyed by the conveyance driving roller 3026 and the driven roller 3027 and the paper P32 is discharged from the opening section formed by the rotation of the front lid portion 3007.

Next, the operation in which the paper P31 and P32 is inverted by the paper inversion unit 3040 and recording is performed on both surfaces, the front surface and the back surface, of the papers P31 and P32 will be explained. The paper P31 conveyed from the paper cassette 3012 via the conveyance paths S31 and S32 and the paper P32 inserted from the feeder opening 3008 are conveyed to the downstream side by the intermediate conveyance driving roller 3050 and the driven roller 3053. At this point, the papers P31 and P32 are each conveyed by the conveyance driving roller 3026 and the driven roller 3027 in a state in which the surface faces upward or to the liquid ejection head 3003 side and an image is recorded on the front surface of the paper P31 and P32 in the recording section 3013.

Then, the paper P31 and P32 on which an image was recorded on the surface is conveyed to the upstream side (hereinafter referred to as "upstream side") in the sub-scanning direction Y by the reversing rotation of the conveyance driving roller 3026, and then conveyed to the conveyance path S34 which is a spatial region between the driven roller 3051 and the swinging member 3045 by the intermediate conveyance driving roller 3050 which is driven in the direction of the arrow and the driven roller 3051.

As shown by the broken line, the tip end section of the swinging member 3045 rotates to the back side and the paper P31 and P32 is conveyed to the conveyance path S31. Then, the paper P31 and P32 is conveyed via the conveyance paths S32 and S33 by the intermediate conveyance driving roller 3050 and the driven rollers 3052 and 3053. At this point, the paper P31 and P32 is conveyed to the downstream side along the conveyance surface 3021*a* in a state in which the back surface faces upward, conveyed by the conveyance driving roller 3026 and the driven roller 3027, and an image is recorded on the back surface of the paper P31 and P32 in the recording section 3013.

On the upstream side of the liquid ejection head 3003, for example, an optical end portion detecting section 3032 for detecting an upstream side and downstream side end portion the of the paper P31 and P32 in the sub-scanning direction Y is provided.

Figure 24:
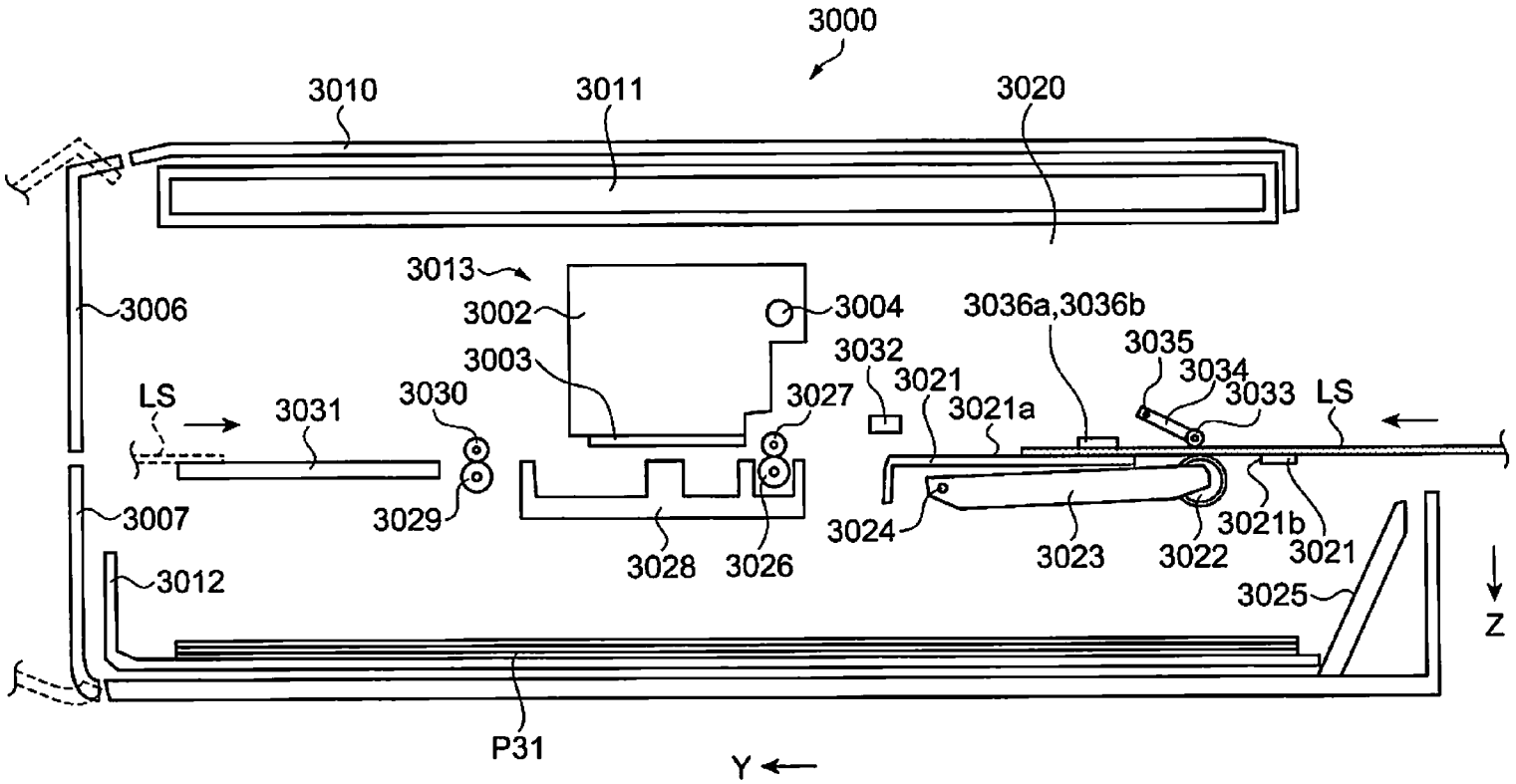
FIG. 24 is a cross-sectional view showing a state in which recording is performed on a lens sheet in a state in which the paper inversion unit is removed.

FIG. 24 is a cross-sectional view showing a state in which recording is performed on a lens sheet LS in a state in which the paper inversion unit 3040 is removed. As shown in FIG. 22, in a state in which the paper inversion unit 3040 is removed, the wall section 3021 provided on the back side of the recording device 3000, the wall sections 3037*a* and 3037*b* provided on both sides of the wall section 3021 in the main scanning direction X, and the driven roller 3033 are exposed. A user places the lens sheet LS on the conveyance surface 3021*a* of the wall section 3021.

Also, since the lens sheet LS has the same structure as the lens sheet LS (see FIG. 8) used in the recording device 1000 according to the aforementioned first embodiment, the explanation will be omitted.

An opening section 3021*b* is formed in the wall section 3021. When the paper inversion unit 3040 is removed from the mounting section 3020, the feeding roller 3022 of FIG. 23 is rotated by a rotating mechanism that is not illustrated, and as shown in FIG. 24, the upper section of the feeding roller 3022 passes through the opening section 3021*b* from the bottom side to be positioned where it comes into contact with the lens sheet LS placed on the conveyance surface 3021*a* of the wall section 3021.

The driven roller 3033 is provided above the feeding roller 3022 in the vertical direction Z in a freely rotatable manner. The driven roller 3033 is provided on a swinging member 3034 which swings about a rotational shaft 3035 as a fulcrum. The rotational shaft 3035 is, as shown in FIG. 22, pivoted by the bearing portions (not illustrated) in which both end sections are provided on the wall sections 3037*a* and 3037*b*.

As shown in FIG. 23, when the paper inversion unit 3040 is mounted to the mounting section 3020, the swinging member 3034 is brought to a rotational position in the horizontal direction shown by a solid line by a rotational mechanism that is not illustrated. Consequently, when recording on both surfaces of the papers P31 and P32, the papers P31 and P32 conveyed to the upstream side will not come into contact with the swinging member 3034 and the driven roller 3033.

When the paper inversion unit 3040 is removed from the mounting section 3020, the swinging member 3034 is brought to a rotational position shown by a broken line in FIG. 23 by a rotational mechanism, and as shown in FIGS. 22 and 24, the driven roller 3033 comes into contact with the feeding roller 3022.

The swinging member 3034 is provided with an elastic member (not illustrated) which moves the driven roller 3033 in a downwardly pressing rotational direction. According to this structure, the lens sheet LS is pinched by the feeding roller 3022 and the driven roller 3033 which are driven and rotated, and conveyed to the downstream side.

In a state in which the paper inversion unit 3040 is removed from the mounting section 3020, a linear conveyance route is constituted along the conveyance surface 3021*a* of the wall section 3021 from the back side of the recording device 3000 and toward a position of the supporting member 3028 facing the liquid ejection head 3003.

Figure 25A:
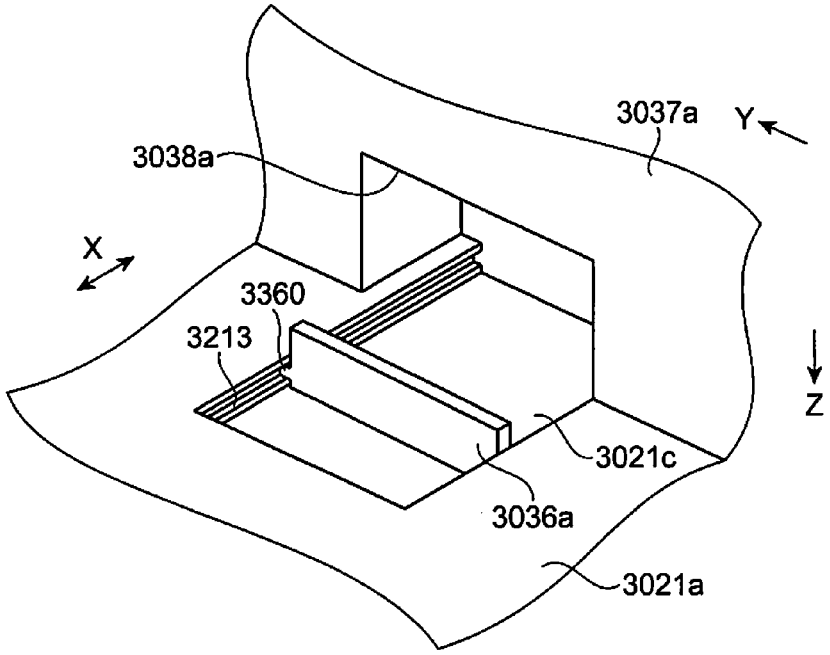
FIGS. 25A and 25B are perspective views showing a portion of an edge guide provided on a conveyance surface.
Figure 25B:
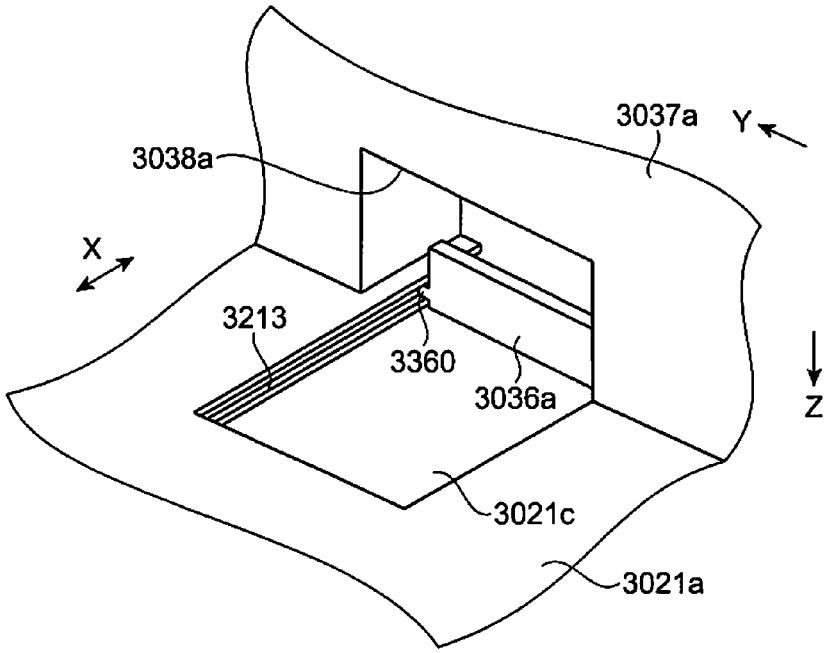

On one side of the conveyance surface 3021*a* of the wall section 3021 of FIG. 22 and FIG. 24 in the main scanning direction X, edge guides 3036*a* are provided, and edge guides 3036*b* are provided on the other side. FIGS. 25A and 25B are a perspective view showing an edge guide 3036*a* provided on one side of a conveyance surface 3021*a* in the main scanning direction X.

On the wall sections 3037*a* and 3037*b* of FIG. 22, concave portions 3038*a* and 3038*b* outwardly depressed in the main scanning direction X are provided. FIG. 25A shows a state in which the edge guide 3036*a* is more inward than the concave portion 3038*a* in the main scanning direction X and FIG. 25B shows a state in which the edge guide 3036*a* is at a position overlapping with the concave portion 3038*a* in the main scanning direction X. That is, the edge guide 3036*a* is in a state in which it is stored in the concave portion 3038*a*.

On the conveyance surface 3021*a*, a concave portion 3021*c* is provided, and on the downstream side and the upstream side of the concave portion 3021*c*, a groove 3213 (the upstream side is not illustrated) extending in the main scanning direction X is provided. On the edge guide 3036*a*, a protruded section 3360 (the upstream side is not illustrated) protruding to the downstream side and the upstream side is provided. The protruded section 3360 moves slidingly in a state in which it is inserted to the groove 3213.

According to this structure, the edge guide 3036*a* is slidably provided along the groove 3213 in the main scanning direction X. The height of the edge guide 3036*a* is higher than the conveyance surface 3021*a* and the edge guide 3036*a* is formed so as to extend in the sub-scanning direction Y. Similarly, the edge guide 3036*b* is slidably provided along the groove section (not illustrated) provided on the upstream side or the downstream side of a concave section (not illustrated) of the conveyance surface 3021*a* in the main scanning direction X. A user sets the position of the edge guides 3036*a* and 3036*b* to a position where they come into contact with both end section of the lens sheet LS in the main scanning direction X.

The positions of both end sections of the lens sheet LS conveyed on the conveyance surface 3021*a* of FIG. 24 in the main scanning direction X are controlled by edge guides 3036*a* and 3036*b* in the main scanning direction X. Also, edge guides 3036*a* and 3036*b* can control the lens sheet LS from tilting with respect to the sub-scanning direction Y.

The end section on the downstream side and the upstream side of the conveyed lens sheet LS conveyed to the downstream side is detected by the end portion detecting section 3032. Furthermore, an image is recorded within the recording section 3013 and the lens sheet LS is discharged from the opening section formed by the rotation of the front lid portion 3007.

On the top section of the wall section 3021 of FIG. 22, a sheet guide 3212 (see FIG. 26A) is provided. The sheet guide 3212 is provided within the maximum range in which both end sections of the lens sheet LS are controlled in the main scanning direction X by the edge guides 3036*a* and 3036*b*. Also, the sheet guide 3212 is provided on the top section of the wall section 3021 in the sub-scanning direction Y from an end section on the front side to the end section on the back side with the exception of the range in which the concave portion 3021*c* where the edge guides 3036*a* is arranged and the concave portion where the edge guide 3036*b* is arranged, are provided.

Figure 26A:
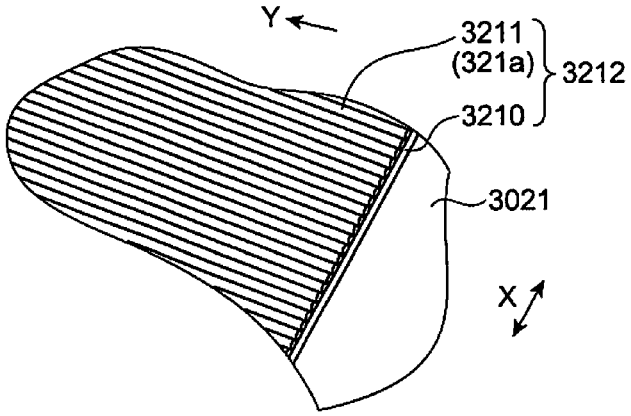
FIG. 26A is a perspective view showing a portion of a sheet guide.
Figure 26B:
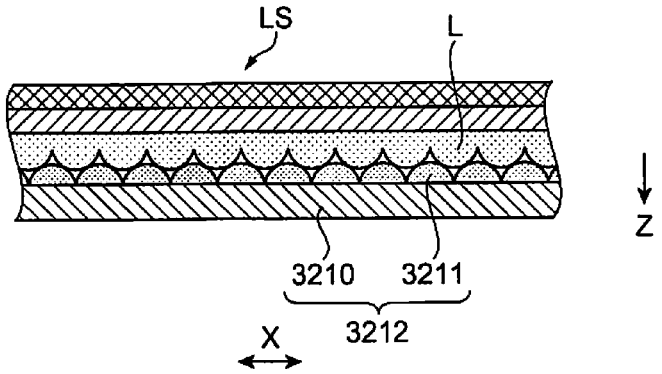
FIG. 26B is a cross-sectional view of a sheet guide and a lens sheet.

FIG. 26A is a view showing a corner section of the back side of the wall section 3021 of FIG. 22 (within the circle of the broken line R3) and the sheet guide 3212 provided on the top section of the wall section 3021. FIG. 26B is a cross-sectional view of the sheet guide 3212 and the lens sheet LS placed on the top section of the sheet guide 3212 as seen from the sub-scanning direction Y. The sheet guide 3212 is constituted by adhering the convex portions 3211 made of the same material as the lenticular lens LS1 on the substrate 3210.

The convex portion 3211 is formed into the same shape as the lenticular lens LS1 of the lens sheet LS and formed with the same pitch as the arranged pitch K of the lenticular lens LS1 as shown in FIG. 8B.

In addition, the interval of the convex portions 3211 in the X direction is not always required to be the same lens pitch K of the lenticular lens LS1 and can be the interval of the integer multiple of the lens pitch K.

Also, when forming the substrate 3210 by resin molding, a mold surface corresponding to the convex portions 3211 can be formed on a molding die in advance and the convex portions 3211 and the substrate 3210 can be formed integrally. Also, by forming the substrate 3210 with resin material having low friction such as a fluororesin, etc., the friction between the lens sheet LS and the convex portion 3211, the friction between the lens sheet LS and the convex portion 3211 can be reduced, thereby allowing a smooth conveyance of the lens sheet LS. Also, the substrate 3210 can be formed with a metal board. In that case, the convex portions 3211 can be formed by subjecting the metal board to a cutting process.

Figure 27:
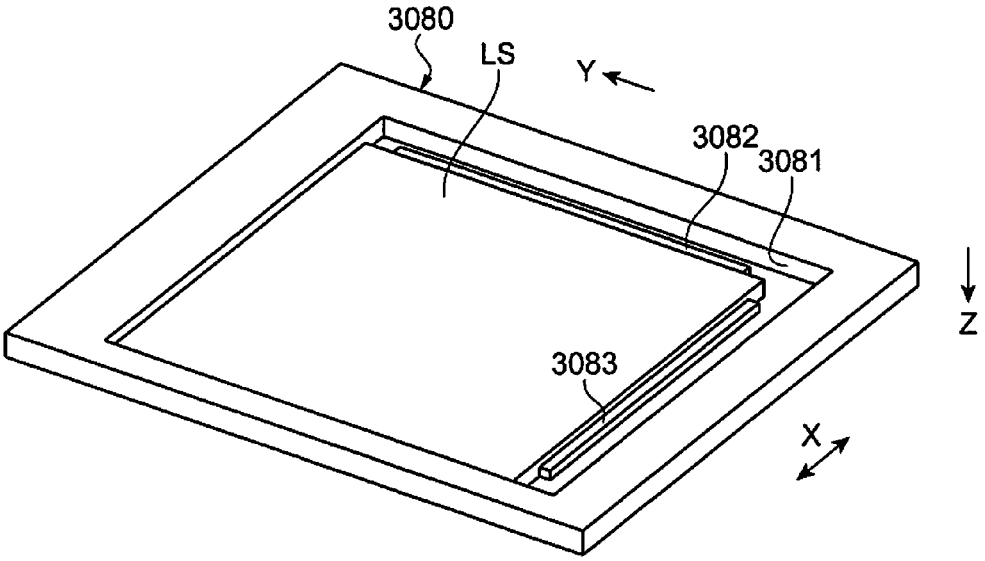
FIG. 27 is a perspective view showing a tray on which a lens sheet is placed.

FIG. 27 is a view showing a tray 3080 on which a lens sheet LS is placed. The tray 3080 on which a lens sheet LS is placed can be placed on the conveyance surface 3021*a* of FIG. 24, and the tray 3080 can be conveyed to the recording section 3013 side by the intermediate conveyance driving roller 3050 and the driven roller 3051 to form an image on the lens sheet LS.

The tray 3080 has an external shape of a rectangle when seen from the vertical direction Z and is provided with a concave portion 3081 having a rectangular shape and depressed than the upper end surface. The lens sheet LS is accommodated in the concave portion 3081. The concave portion 3081 is equipped with a pressing member 3082 for pressing the end section of the lens sheet LS in the main scanning direction X and a pressing member 3083 for pressing the end section of the lens sheet LS in the sub-scanning direction Y. Consequently, the position of the lens sheet LS is fixed with respect to the tray 3080.

Also, as shown in FIG. 24, in a state in which the paper inversion unit 3040 is removed from the mounting section 3020, the upstream side of the recording section 3013 is in an open state. Consequently, the recording device 3000 can also perform recording on the lens sheet LS inserted from the front side of the housing 3005. A user, as shown with a broken line, rotates both the operation panel 3006 of FIG. 20A and the front lid portion 3007 to the front surface side, and in a state in which the front side of the recording device 3000 is in an open state, inserts the lens sheet LS from the front surface side along the top surface of the conveyance path forming member 3031.

The recording device 3000 conveys the lens sheet LS to the upstream side using the discharge driving roller 3029, the driven roller 3030, the conveyance driving roller 3026 and the driven roller 3027 of FIG. 24. Then, while conveying the lens sheet LS to the downstream side, recording is performed on the lens sheet LS by the recording section 3013. When conveying the lens sheet LS to the upstream side, recording can be performed on the lens sheet LS by the recording section 3013.

The paper P31 and P32 is a first recording medium. The first recording medium is constituted by a flexible member such as a paper material and the first recording medium does not stop on a curved conveyance route or receive damage by passing through a curved conveyance route.

The lens sheet LS is a second recording medium. The second recording medium is constituted so as to include resin and metal members, etc. Also, the second recording medium includes a material constituted by a thick paper material.

The paper inversion unit 3040 constitutes a first conveyance device. In the paper inversion unit 3040 of FIG. 23, a curved inversion path curved by the conveyance paths S31, S32 and S34 is provided on the outer peripheral side of the intermediate conveyance driving roller 3050.

The recording device 3000 explained as the aforementioned embodiment includes a recording section 3013 for performing recording on papers P31 and P32 as the first recording medium and a lens sheet LS as the second recording medium, a housing 3005 provided with a mounting section 3020 and for storing a recording section 3013 and a paper cassette 3012, a paper cassette 3012 as a recording medium storage section for storing the paper P31, a paper inversion unit 3040 as a curved route conveyance portion, which is detachably provided on the mounting section 3020, having a curved route for conveying the paper P31 fed from the paper cassette 3012 side to the recording section 3013 side, and a linear conveyance route for linearly conveying the lens sheet LS as the second recording medium in a state in which the paper inversion unit 3040 is removed from the housing 3005.

According to this structure, the lens sheet is conveyed on the linear conveyance route to be recorded by the recording section 3013 without being conveyed on the curved route. Therefore, the lens sheet LS will not stop or be damaged on the curved route. Therefore, since the recording device 3000 can be configured as a common recording device 3000 for performing recording on a paper P31 and P32, and a lens sheet LS and not as a recording device dedicated for performing recording on a lens sheet LS, an increase in manufacturing cost of the recording device can be restrained.

Also, a paper cassette 3012 for storing a paper P31 and a feeding roller 3022 for feeding the paper P31 stored in the paper cassette 3012 to the paper inversion unit 3040 side are provided, and the lens sheet LS is conveyed by the feeding roller 3022.

According to this structure, since the feeding roller 3022 for feeding the paper P31 to the paper inversion unit 3040 side can be commonly used, an increase in manufacturing cost can be restrained.

Further, the linear conveyance route is equipped with edge guides 3036*a* and 3036*b* for controlling the positions of the end sections of the lens sheet LS in a direction intersecting (sub-scanning direction Y) with the conveyance direction (main scanning direction X) and guiding the conveyance direction of the lens sheet LS as the guide section.

Since edge guides 3036*a* and 3036*b* control the lens sheet LS from tilting with respect to the conveyance direction, it becomes possible to stereoscopically view the image formed on the lens sheet LS and the quality of an image formed on the lens sheet LS can be controlled from being deteriorated.

Further, the lens sheet LS is placed and conveyed on the tray 3080. Consequently, the positional change of the lens sheet LS can be controlled.

Also, the mounting stand 3056 of FIG. 25A is equipped with the sheet guide 3212 having a plurality of convex portions 3211 and the plurality of convex portions 3211 constitute engaging sections to be engaged with the lens L forming an irregular portion of the lens sheet LS in a direction intersecting with the conveyance direction of the lens sheet LS.

According to this structure, the position of the lens sheet LS can be determined in a direction intersecting with the conveyance direction of the lens sheet LS.

Further, the paper inversion unit 3040 conveys a paper P31 and P32 in a state in which the recording surface is inverted. Consequently, the recording surface of the paper P31 and P32 can be inverted using the paper inversion unit 3040.

Further, the lens sheet LS explained in FIG. 8 has a structure for forming a stereoscopically visible image by parallax variation. According to this structure, a stereoscopically visible image by parallax variation can be formed on the lens sheet LS using the recording device 3000.

The recording device 3000 of FIG. 23 in this embodiment is provided, on the upstream side of the recording section 3013, with a portion in which the conveyance routes of papers P31 and P32 intersect (conveyance path S33), but the present invention can be applied to a recording device provided with a portion where the conveyance route of the papers intersect is provided at the downstream side of the recording section.

Figure 28:
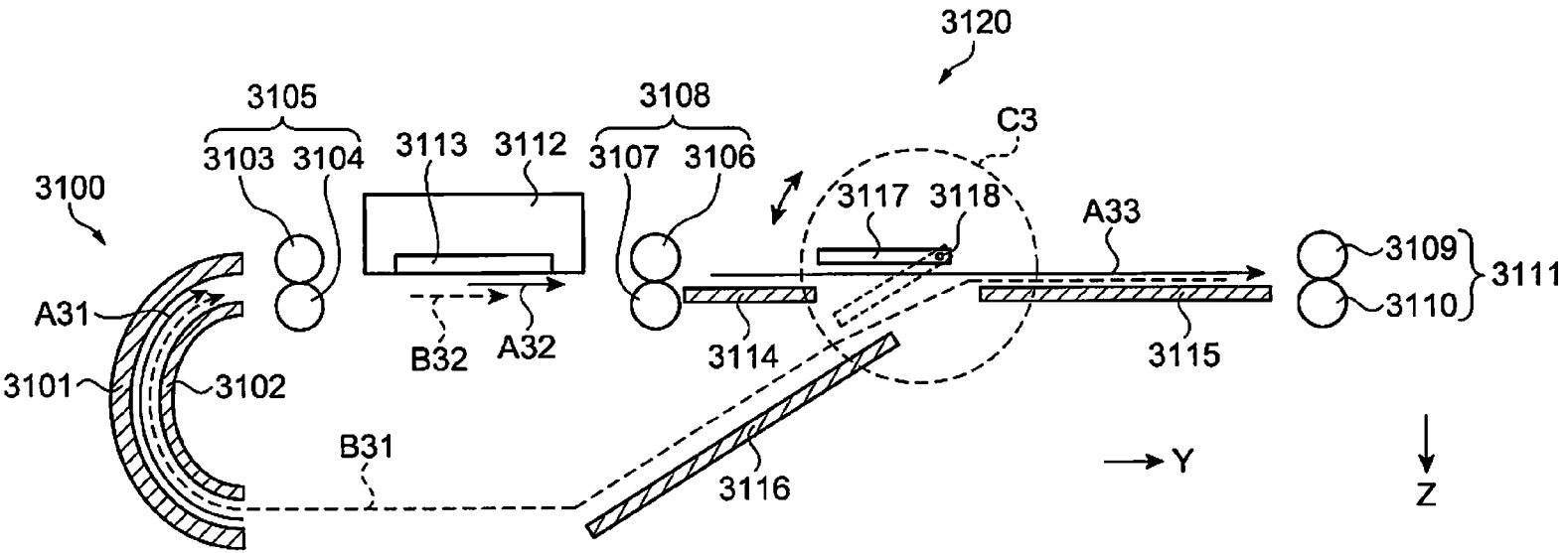
FIG. 28 is a view showing a schematic configuration of the recording device in which a portion where a conveyance route of a paper intersects is provided on a downstream side of a recording section in a sub-scanning direction.

FIG. 28 is a view seen from the main scanning direction, showing a schematic configuration of the recording device 3120 in which a portion where conveyance routes of paper intersect is provided at a downstream side of a recording section. The recording device 3120 is equipped with a paper inversion section 3100 having a curved route between the inner wall section 3102 and the outer wall section 3101. Also, on the downstream side of the recording section configured to include a liquid ejection head 3113 provided on a carriage 3112 that is reciprocated in the main scanning direction, a portion C3 where the conveyance routes of papers intersect is provided (within the circle as shown by the broken line). A portion C3 where the conveyance route of a paper intersects, a swinging member 3117 which swings about a rotational axis 3118 as a fulcrum is provided.

On the upstream side of the liquid ejection head 3113, a pair of rollers 3105 is provided, in which one of the rollers 3103 and 3104 is a driving roller and the other is a driven roller. On the downstream side of the liquid ejection head 3113, a pair of rollers 3108 is provided, in which one of the rollers 3106 and 3107 is a driving roller and the other is a driven roller, and a pair of rollers 3111 is provided, in which one of the rollers 3109 and 3110 is a driving roller and the other is a driven roller.

As shown by the solid lines A31 and A32, via the paper inversion section 3100, a paper is conveyed to the downstream side (right side of the drawing) along the member 3114 constituting the conveyance surface by the pair of rollers 3105 and 3108. On the conveyed paper, an image is formed on one of the recording surfaces at a position facing the liquid ejection head 3113.

As shown by the solid arrow A33, since the swinging member 3117 is at a rotating position as shown by a solid line and the conveyance route is in an open state, the paper is conveyed to the downstream side along a member 3115 constituting the conveyance surface by the pair of rollers 3111.

Also, the paper is conveyed to the upstream side (left side of the drawing) from the reverse rotation of the pair of rollers 3111. At this time, the swinging member 3117 rotates to the position as shown by the broken line, which in turn closes the conveyance route on the member 3114 side and opens the conveyance route on the member 3116 side, and as shown by the broken line arrow B31, the paper is conveyed along a member 3116 constituting the conveyance surface. Then, the paper again goes through the curved route of the paper inversion section 3100 and the position facing the liquid ejection head 3113, and an image is formed on the other recording surface.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a device main body;

a recording section provided at the device main body and configured to record on a first recording medium and a second recording medium having lenticular lenses;

a mounting section configured to selectively mount a first conveyance unit configured to convey the first recording medium and a second conveyance unit configured to convey the second recording medium; and a first recording medium storage section configured to store the first recording medium, wherein the first conveyance unit includes a curved inversion path for inverting the first recording medium fed from the first recording medium storage section in a curved manner and guiding the first recording medium to the recording section, and the second conveyance unit does not include the curved inversion path and includes a linear conveyance route for linearly conveying and guiding the second recording medium to the recording section.

2. The recording device according to claim 1, wherein the first recording medium is fed by a first feeding roller of the device main body, the second recording medium is fed by a second feeding roller of the second conveyance unit, and either of the first and second feeding rollers is driven by a same driving source.

3. The recording device according to claim 2, wherein the second recording medium is placed on the linear conveyance route.

4. The recording device according to claim 3, wherein the second conveyance unit is configured to convey a tray for placing the second recording medium thereon.

5. The recording device according to claim 4, wherein the second recording medium is conveyed from a front side or a back side of the device main body.

6. The recording device according to claim 4, further comprising a liquid ejection head provided at the recording section and configured to eject a liquid, and a supporting member having a supporting surface configured to support the second recording medium or the tray at a position facing the liquid ejection head, wherein at a time of mounting the second conveyance unit, a conveyance surface of the second conveyance unit and the supporting surface of the supporting member are formed so as to be approximately a same surface.

7. The recording device according to claim 4, wherein the second conveyance unit is equipped with a press roller configured to press the second recording medium or the tray.

8. The recording device according to claim 7, wherein the second conveyance unit is equipped with a conveyance driving roller configured to convey the second recording medium.

9. The recording device according to claim 8, wherein the conveyance driving roller is driven by a driving force of conveying the first recording medium.

10. The recording device according to claim 9, wherein the second conveyance unit is equipped with a guide section configured to control a position of an end portion of the second recording medium intersecting with a conveyance direction of the second recording medium and guide the conveyance direction of the second recording medium.

11. The recording device according to claim 10, wherein the second conveyance unit is equipped with engaging sections to be engaged with an irregular portion of the second recording medium in a direction intersecting with the conveyance direction of the second recording medium, and the engaging sections are arranged at intervals of integral multiple of a lens pitch of the lenticular lenses provided on the second recording medium.

12. The recording device according to claim 11, wherein the first conveyance unit is configured to convey the first recording medium in which a recording face is in an inverted state.

13. The recording device according to claim 12, further comprising a control unit configured to control the recording section, wherein when ejecting an ink toward the second recording medium from the recording section so as to form an image corresponding to each of the lenticular lenses, the control unit is configured to control the recording section such that a carriage performs recording on the second recording medium from a reference side set to an edge on one side in a main scanning direction which is a direction intersecting with the conveyance direction of the second recording medium to an edge on the other side, and a width of a lens of the lenticular lenses, which forms an edge on the reference side in the main scanning direction corresponds to a width of an adjacent lens of the lenticular lenses, which is adjacent to the lens forming the edge in the main scanning direction.

14. A recording device comprising:

a recording section configured to record on a first recording medium and a second recording medium having lenticular lenses;

a recording medium storage section configured to store the first recording medium;

a curved route conveyance section having a curved route and configured to convey the first recording medium fed from a side of the recording medium storage section to a side of the recording section; and a mounting stand configured to place the second recording medium;

the curved route conveyance section having an opening section such that the second recording medium is inserted into the opening section, the opening section is provided in a linear conveyance route for linearly conveying the second recording medium to the side of the recording section such that the second recording medium passes through, and the mounting stand includes a supporting section for displaceably rotating between a use state and a non-use state.

15. The recording device according to claim 14, wherein the mounting stand further includes engaging sections to be engaged with an irregular portion of the second recording medium in a direction intersecting with a conveyance direction of the second recording medium, and the engaging sections are arranged at intervals of integer multiple of a lens pitch of the lenticular lenses provided on the second recording medium.

16. The recording device according to claim 15, further comprising a control unit configured to control the recording section, wherein when ejecting an ink toward the second recording medium from the recording section so as to form an image corresponding to each of the lenticular lenses, the control unit is configured to control the recording section such that a carriage performs recording on the second recording from a reference side set to an edge on one side in a main scanning direction which is the direction intersecting with the conveyance direction of the second recording medium to an edge on the other side, and a width of a lens of the lenticular lenses, which forms an edge on the reference side in the main scanning direction corresponds to a width of an adjacent lens of the lenticular lenses, which is adjacent to the lens forming the edge in the main scanning direction.

17. A recording device comprising:

a recording section configured to record on a first recording medium and a second recording medium having lenticular lenses;

a recording medium storage section configured to store the first recording medium;

a housing provided with a mounting section and configured to store the recording section and the recording medium storage section;

a curved route conveyance section detachably provided at the mounting section of the housing and having a curved route, the curved route conveyance section being configured to convey the first recording medium fed from the recording medium storage section side to a side of the recording section;

a linear conveyance route configured to linearly convey the second recording medium in a state in which the curved route conveyance section is removed from the housing;

a recording medium storage section configured to store the first recording medium; and a feeding roller configured to feed the first recording medium stored in the recording medium storage section to a side of the curved route conveyance section, the second recording medium being conveyed in a manner such that the feeding roller comes into contact with the lenticular lenses.

18. The recording device according to claim 17, wherein the linear conveyance route is provided with engaging sections to be engaged with an irregular portion of the second recording medium in a direction intersecting with a conveyance direction of the second recording medium, and the engaging section is arranged at intervals of integer multiple of a lens pitch of the lenticular lenses of the second recording medium.

19. The recording device according to claim 18, further comprising a control unit configured to control the recording section, wherein when ejecting an ink toward the second recording medium from the recording section so as to form an image corresponding to each lenticular lens, the control unit is configured to control the recording section such that a carriage performs recording on the second recording from a reference side set to an edge on one side in a main scanning direction which is the direction intersecting with the conveyance direction of the second recording medium to an edge on the other side, and a width of a lens of the lenticular lenses, which forms an edge on the reference side in the main scanning direction corresponds to a width of an adjacent lens of the lenticular lenses, which is adjacent to the lens forming the edge in the main scanning direction.

* * * * *